US007125108B2

(12) United States Patent
Toba et al.

(10) Patent No.: US 7,125,108 B2
(45) Date of Patent: Oct. 24, 2006

(54) LIQUID CARTRIDGE

(75) Inventors: Koichi Toba, Nagano-ken (JP); Satoshi Shinada, Nagano-ken (JP); Yasuto Sakai, Fukai-ken (JP); Kenji Ito, Nagano-ken (JP); Akira Ichihashi, Nagano-ken (JP); Yuichi Seki, Nagano-ken (JP); Akihiko Kitazawa, Nagano-ken (JP); Taku Ishizawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 179 days.

(21) Appl. No.: 10/732,017

(22) Filed: Dec. 10, 2003

(65) Prior Publication Data

US 2004/0174418 A1 Sep. 9, 2004

(30) Foreign Application Priority Data

| | | |
|---|---|---|
| Dec. 10, 2002 | (JP) | 2002-358762 |
| Dec. 10, 2002 | (JP) | 2002-358763 |
| Jan. 21, 2003 | (JP) | 2003-012845 |
| Jan. 21, 2003 | (JP) | 2003-012846 |
| Jul. 14, 2003 | (JP) | 2003-196298 |
| Aug. 26, 2003 | (JP) | 2003-301246 |
| Aug. 28, 2003 | (JP) | 2003-304171 |
| Dec. 2, 2003 | (JP) | 2003-402665 |

(51) Int. Cl.
*B41J 2/175* (2006.01)

(52) U.S. Cl. ..... 347/86

(58) Field of Classification Search ..... 347/85, 347/86, 87
See application file for complete search history.

(56) References Cited

U.S. PATENT DOCUMENTS

| | | | | |
|---|---|---|---|---|
| 6,193,364 | B1 * | 2/2001 | Iida | 347/86 |
| 6,773,099 | B1 * | 8/2004 | Inoue et al. | 347/86 |
| 2005/0134661 | A1 | 6/2005 | Miyazawa | |

FOREIGN PATENT DOCUMENTS

| | | |
|---|---|---|
| EP | 0 633 137 A 2 | 1/1995 |
| EP | 1 016 533 A1 | 7/2000 |
| EP | 1 199 178 A 1 | 4/2002 |
| EP | 1199179 A1 | 4/2002 |
| JP | 60-206651 A | 10/1985 |

(Continued)

OTHER PUBLICATIONS

European Search Report dated May 21, 2004 in European Pat. Appln. No. 03 02 8275.

(Continued)

*Primary Examiner*—Anh T. N. Vo
(74) *Attorney, Agent, or Firm*—Stroock & Stroock & Lavan LLP

(57) ABSTRACT

A liquid cartridge is provided that supplies liquid to a liquid ejecting apparatus by being mounted in the liquid ejecting apparatus. The liquid cartridge includes a cartridge body having a side face in which an opening is formed; and a flexible film for forming an ink accommodating chamber that is a closed space for accommodating the liquid, with the cartridge body by covering the opening of the cartridge body. The flexible film is caused to deform toward the ink accommodating chamber by atmospheric pressure that acts on the flexible film when the liquid cartridge is got out from a vacuum bag in which the liquid cartridge is packaged, thereby increasing the pressure in the ink accommodating chamber.

23 Claims, 28 Drawing Sheets

FOREIGN PATENT DOCUMENTS

| | | | | |
|---|---|---|---|---|
| JP | 2-502564 | A | 8/1990 | |
| JP | 4-327948 | A | 11/1992 | |
| JP | 5-229137 | A | 9/1993 | |
| JP | 6-191046 | A | 7/1994 | JP |
| 6-210869 | | A | 8/1994 | JP |
| 7-266575 | | A | 10/1995 | JP |
| 8-119305 | | A | 5/1996 | JP |
| 8-183185 | | A | 7/1996 | JP |
| 10-000314 | | A | 1/1998 | JP |
| 10-235889 | | A | 9/1998 | JP |
| 11-70672 | | A | 3/1999 | JP |
| 11-170564 | | A | 6/1999 | JP |
| 11-286121 | | A | 10/1999 | JP |
| WO00/03877 | | * | 1/2000 | JP |
| 2001-113723 | | A | 4/2001 | JP |
| 2001-219575 | | A | 4/2001 | JP |
| 2001-191548 | | A | 7/2001 | JP |
| 2001-212977 | | A | 8/2001 | JP |
| 2001-277530 | | A | 10/2001 | JP |
| 2001-293876 | | A | 10/2001 | JP |
| 2001-341324 | | A | 12/2001 | JP |
| 2002-17835 | | A | 2/2002 | JP |
| 2002-120379 | | A | 4/2002 | JP |
| 2002-154217 | | A | 5/2002 | JP |
| 2002-205414 | | A | 7/2002 | JP |
| 2002-292744 | | A | 10/2002 | WO |
| 88/04381 | | | 6/1988 | |

OTHER PUBLICATIONS

Search Report from European Patent Appln. 03 02 8275.0 (Jul. 29, 2004).

Office Action in Japanese Patent Appln. No. 2003-204740 (Sep. 14, 2005), w/ Engl. Transln.

Office Action in Japanese Patent Appln. No. 2003-205038 (Sep. 1, 2005), w/ Engl. Transln.

Office Action in Japanese Patent Appln. No. 2003-301246 (Sep. 1, 2005), W/ Engl. Transln.

Office Action in Japanese Patent Appln. No. 2003-304171 (Aug. 16, 2005), w/ Engl. Transln.

* cited by examiner

LIQUID CARTRIDGE

This patent application claims priority from Japanese patent applications Nos. 2002-358762 filed on Dec. 10, 2002, 2002-358763 filed on Dec. 10, 2002, 2003-012845 filed on Jan. 21, 2003, 2003-012846 filed on Jan. 21, 2003, 2003-196298 filed on Jul. 14, 2003, 2003-301246 filed on Aug. 26, 2003, 2003-304171 filed on Aug. 28, 2003, and 2003-402665 filed on Dec. 2, 2003, the contents of which are incorporated herein by reference.

BACKGROUND OF THE INVENTION

1. Field of the Invention

The present invention relates to a liquid cartridge. More particularly, the present invention relates to a liquid cartridge for accommodating liquid while maintaining a negative pressure by means of a differential pressure regulating valve and supplying the liquid to a liquid ejection head via a supply portion thereof while keeping a constant negative pressure.

2. Description of the Related Art

An ink cartridge for supplying ink while keeping the pressure at an ink supply port to be a negative pressure that does not allow leak of ink by using a pressure difference regulating valve is distributed while being packed in a sealed package under reduced pressure. Therefore, at the initial use of the ink cartridge, the pressure in an ink supply pass from the ink supply port to an ink accommodating chamber is kept lower than atmospheric pressure.

Thus, when new ink is supplied from the cartridge to an ink-jet head, that is an exemplary liquid ejection head, air bubbles that entered the ink-jet head or an ink-supply needle when the cartridge is detached or attached can be dissolved easily by the degassed ink supplied from the cartridge. This provides an advantage that ink ejection characteristics can be maintained whether the air bubbles entered or not.

On the other hand, at a time when the ink supply port of the cartridge is mounted onto the ink-supply needle, the negative pressure in the cartridge acts on the ink-jet head. Therefore, meniscus at a nozzle opening of the ink-jet head may be undesirably drawn toward the cartridge. This may adversely affect the ink-ejection characteristics.

Therefore, the ink cartridge mentioned above adopts a structure in which the ink accommodating chamber is released to ambient air before the ink-supply needle in communication with the liquid ejection head, i.e., the ink-jet head communicates with the ink supply port, as described in EP-A-1199179, for example.

However, this structure has a problem that an arrangement or design for opening an air valve and a position of an air valve are restricted and, thus, the structure of the holder or liquid emission cartridge becomes complicated.

SUMMARY OF THE INVENTION

Therefore, it is an object of the present invention to provide a liquid cartridge, which is capable of overcoming the above drawbacks accompanying the conventional art. More specifically, the present invention aims at providing a liquid cartridge that requires no special arrangement of a holder for opening an air valve before insertion of an ink-supply needle into an ink supply port, thereby preventing a negative pressure in a liquid cartridge from affecting a liquid ejection head irrespective of the negative pressure in an ink accommodating chamber of the liquid cartridge. The above and other objects can be achieved by combinations described in the independent claims. The dependent claims define further advantageous and exemplary combinations of the present invention.

According to the first aspect of the present invention, a liquid cartridge for supplying liquid to a liquid ejecting apparatus when mounted thereon, comprises: a housing having a side face formed with an opening, the case including a liquid supply section for supplying liquid to the liquid ejecting apparatus; a flexible film forming with the case a liquid accommodating chamber for accommodating liquid by covering the opening of the case, the flexible film being elastically deformable by a differential pressure between atmospheric pressure and a pressure in the liquid accommodating chamber; and an opening portion operated by an operation from an outside to open the liquid accommodating chamber to ambient air.

According to the above, the opening of the liquid accommodating chamber is sealed with the flexible film that can be deformed by the differential pressure between the pressure inside the liquid accommodating chamber and atmospheric pressure. Therefore, the flexible film is deformed toward the liquid accommodating chamber before the ink cartridge is mounted in the liquid ejecting apparatus while being depressurized in order to expel air and being shielded from the outside, thereby the pressure inside the liquid accommodating chamber is returned to atmospheric pressure quickly. Thus, it is possible to suppress suction of liquid from the liquid ejection head toward the liquid accommodating chamber as little as possible, thereby reducing the drawing or pulling of meniscus in the liquid ejection head.

The liquid accommodating chamber may include an atmospheric-side accommodating chamber to be in communication with ambient air and a liquid-supply-side accommodating chamber in communication with the atmospheric-side accommodating chamber, and the film may cover the atmospheric-side accommodating chamber and the liquid-supply-side accommodating chamber.

In this case, it is possible to elastically deform the area corresponding to almost all the area of the opening of the cartridge when the cartridge is put out from a vacuum bag, so as to release the negative pressure inside the cartridge. Therefore, it is possible to reduce the drawing or pulling of the meniscus in the liquid ejection head more reliably.

The liquid cartridge may further comprise: a passage provided on a surface of the case, the passage being opened to ambient air at one end; and a chamber provided on the way of the passage, the chamber having a depth deeper than a depth of the passage. In this case, it is possible to remove the reduced pressure in the cartridge at the start of the use of the cartridge because the chamber serves as a buffer.

According to the second aspect of the present invention, a liquid cartridge for supplying liquid to a liquid ejecting apparatus by being mounted in the liquid ejecting apparatus, comprises: a liquid accommodating chamber; a supply portion for supplying liquid accommodated in the liquid accommodating chamber to the liquid ejecting apparatus; a partitioning wall, provided between the liquid accommodating chamber and the supply portion, having a communication hole communicating the liquid accommodating chamber with the supply portion; a membrane valve, arranged on a supply-portion side of the partitioning wall, for controlling communication or non-communication between the liquid accommodating chamber and the supply portion; and a deformation regulating portion which allows the membrane valve to close and to regulate elastic deformation of the membrane valve toward the liquid accommodating chamber caused by increase of a pressure on a supply-member side of the membrane valve.

In this case, even if the supply portion is brought into contact with the liquid ejecting apparatus and the membrane valve is tried to be elastically deformed by the differential pressure, the membrane valve is stopped at a predetermined position forcedly by coming into contact with the deformation regulating portion. Therefore, it is possible to make the meniscus at a nozzle opening of the liquid ejection head stay at a position that allows formation of the liquid drops.

The film may include a plurality of layers, material of an innermost one of the plurality of layers being the same as material of the case. In this case, it is possible to make the film adhere to the case by heat reliably. Moreover, the film may further include an anti-permeation layer for preventing permeation of liquid vapor in the liquid cartridge to an outside of the liquid cartridge through the film. In this case, it is possible to prevent ink vapor from passing through the film to the outside of the liquid cartridge. Furthermore, the film may further include a strengthening layer that is higher in strength than the innermost layer. In this case, the strength can be provided to the film by the strengthening layer.

The liquid cartridge may further comprise: a passage provided on a surface of the case, the passage being opened to ambient air at one end; and a chamber provided on the way of the passage, the chamber having a depth deeper than a depth of the passage In this case, it is possible to remove the reduced pressure in the cartridge at the initial use of the cartridge because the chamber serves as a buffer. The liquid cartridge may further comprise a cover, provided in an outside of the film, which prevents expansion of the film to the outside. By bringing the cover into close contact with the film, it is possible to prevent ink leak to the outside of the liquid cartridge caused by the deformation of the film.

The deformation regulating portion may be formed by a protrusion provided at a position of the partitioning wall, the position being opposed to a periphery region of the membrane valve.

The deformation regulating portion may be provided on a face of the membrane valve, the face being opposed to the partitioning wall, and the deformation regulating portion may be formed as a thicker portion that comes into contact with the partitioning wall when the membrane valve is closed.

The deformation regulating portion may be formed as an approximately annular ridge having a cut portion in a region connecting communication holes formed in the partitioning wall.

The membrane valve may be closed by coming into contact with the communication hole of the partitioning wall.

The membrane valve may include a communication hole formed therein, and a sealing portion for sealing the communication hole of the membrane valve is formed on the partitioning wall.

The film may include a plurality of layers, material of an innermost one of the plurality of layers being the same as material of the case.

The film may further include an anti-permeation layer for preventing permeation of liquid vapor in the liquid cartridge to an outside of the liquid cartridge through the film.

The film may further include a strengthening layer that is higher in strength than the innermost layer.

According to the third aspect of the present invention, a liquid cartridge for supplying liquid to a liquid ejecting apparatus when mounted thereon, comprises: a liquid accommodating chamber; a supply portion for supplying liquid accommodated in the liquid accommodating chamber to the liquid ejecting apparatus; and a membrane valve, provided between the liquid accommodating chamber and the supply portion, for controlling communication or non-communication between the liquid accommodating chamber and the supply portion, wherein the liquid cartridge is filled with the liquid in such a manner that a pressure on a supply-portion side of the membrane valve is higher than a pressure on a liquid-accommodating portion side of the membrane valve to a degree allowing elastic deformation of the membrane valve.

According to the above, it is possible to suppress the moving of the liquid as the volume is changed by the deformation of the membrane valve toward the liquid accommodating chamber when the ink cartridge is mounted on the liquid ejecting apparatus. Thus, it is possible to make the meniscus in the nozzle opening of the liquid ejection head reliably stay at a position allowing the formation of liquid drops.

The control of the communication or non-communication between the liquid accommodating chamber and the supply portion may be performed by moving a communication hole formed in a partitioning wall for sectioning the liquid accommodating chamber and the supply portion away from the membrane valve to open the communication hole or closing the communication hole with the membrane valve.

The control of the communication or non-communication between the liquid accommodating chamber and the supply portion may be performed by forming a communication hole in the membrane valve, sectioning the liquid accommodating chamber and the supply portion by the membrane valve, and moving the communication hole of the membrane valve away from a sealing member to open the communication hole or closing the communication hole with the sealing member.

The liquid cartridge may further comprise an opening portion for communicating the liquid accommodating chamber with ambient air in accordance with a state of liquid consumption in the liquid accommodating chamber.

The opening portion may be operated by a pressing member formed on a holder onto which the liquid cartridge is mounted.

According to the fourth aspect of the present invention, a method of manufacturing a liquid cartridge is provided that includes: a liquid accommodating chamber; a supply portion for supplying liquid accommodated in the liquid accommodating chamber to a liquid ejecting apparatus, and a membrane valve, provided between the liquid accommodating chamber and the supply portion, for controlling communication or non-communication between the liquid accommodating chamber and the supply portion, wherein the liquid cartridge supplies the liquid to the liquid ejecting apparatus when mounted thereon. The method comprises: a first step for injecting liquid to the liquid accommodating chamber; and a second step for loading a connector for liquid injection into the supply portion and injecting the liquid until a pressure in a space from the supply portion to the membrane valve is increased to cause elastic deformation of the membrane valve.

According to the fifth aspect of the present invention, a method of manufacturing a liquid cartridge is provided that includes: a liquid accommodating chamber; a supply portion for supplying the liquid accommodated in the liquid accommodating chamber to a liquid ejecting apparatus; and a membrane valve, provided between the liquid accommodating chamber and the supply portion, for controlling communication or non-communication between the liquid accommodating chamber and the supply portion, wherein the liquid cartridge supplies the liquid to the liquid ejecting apparatus by being mounted in the liquid ejecting apparatus. The method comprises: a first step for injecting liquid into the liquid accommodating chamber while the liquid is pressurized; and a second step for communicating the liquid accommodating chamber with ambient air to relatively increase a pressure in a space from the supply portion to the membrane valve to cause elastic deformation of the membrane valve.

According to the above method, it is possible to easily manufacture the liquid cartridge which can reliably keep the meniscus in the nozzle opening of the liquid ejection head on the position that allows the formation of liquid drops by simple work, i.e., additionally injecting the liquid after the liquid is injected into the liquid accommodating chamber or relatively reducing the pressure inside the liquid accommodating chamber.

The first step may be performed after discharge of air from a space from the supply portion to the liquid accommodating chamber. In this case, it is possible to fill the flow path such as the ink accommodating chamber with the liquid with no existing air.

According to the sixth aspect of the present invention, there is provided a liquid cartridge for supplying liquid to a liquid ejecting apparatus when mounted thereon. The liquid cartridge includes: a liquid accommodating chamber; a supply portion for supplying liquid accommodated in the liquid accommodating chamber to the liquid ejecting apparatus; an atmospheric valve selectively opening and sealing a communication hole through which the liquid accommodating chamber communicates with ambient air; and a biasing member for biasing the atmospheric valve toward the communication hole for sealing the communication hole. Biasing force of the biasing member is determined so that the atmospheric valve opens the communication hole when the liquid cartridge with the liquid accommodating chamber, which is packed and sealed in a vacuum package under a negative pressure lower than atmospheric pressure, is exposed to atmosphere by opening the package. Accordingly, since the atmospheric valve opens the communication hole once so that the liquid accommodating chamber is in communication with ambient air when the pressure in the liquid accommodating chamber of the liquid cartridge is lower than atmospheric pressure, the difference between pressure in the liquid accommodating chamber and atmospheric pressure can be reduced. Therefore, when the liquid cartridge is mounted in the liquid ejecting apparatus, the liquid cartridge is prevented from drawing the liquid from the liquid ejecting apparatus.

The biasing member of the liquid cartridge may include a spring. Based on the biasing force of the spring used as the biasing member, how much the pressure difference between the liquid accommodating chamber and atmosphere is to be reduced is adjustable. Moreover, the spring may bias the atmospheric valve toward the communication hole from a side of the liquid accommodating chamber to a side of atmosphere. Accordingly, when the liquid cartridge is exposed to atmosphere, the atmospheric valve can open the communication hole and the liquid accommodating chamber is in communication with ambient air with simple configuration.

The liquid cartridge may further include a seal for sealing the supply portion, wherein the seal is removed before initial use of the liquid cartridge. Accordingly, when the liquid cartridge is taken out from a vacuum package and the liquid cartridge is exposed to atmosphere, a side of the supply portion can be prevented from being exposed to atmosphere, and the liquid accommodating chamber is in communication with ambient air by certainly moving the atmospheric valve to open the communication hole.

According to the liquid cartridge, the liquid cartridge may be packed and sealed in a vacuum package under a negative pressure lower than atmospheric pressure, and the liquid cartridge may be exposed to atmosphere by opening the vacuum package and the atmospheric valve opens the communication hole against the biasing force of the biasing member. Accordingly, since the atmospheric valve opens the communication hole once so that the liquid accommodating chamber is in communication with ambient air when the liquid cartridge is taken out from the vacuum package and is exposed to atmosphere, the pressure difference between the liquid accommodating chamber and atmosphere is reducible. Therefore, when the liquid cartridge is mounted in the liquid ejecting apparatus after the vacuum package is opened and the liquid cartridge is exposed to atmosphere, the liquid cartridge is prevented from drawing the liquid from the liquid ejecting apparatus.

The summary of the invention does not necessarily describe all necessary features of the present invention. The present invention may also be a sub-combination of the features described above. The above and other features and advantages of the present invention will become more apparent from the following description of the embodiments taken in conjunction with the accompanying drawings.

BRIEF DESCRIPTION OF THE DRAWINGS

FIG. 20A shows a state in which ink is not supplied while FIG. 20B shows a state in which ink is supplied.

FIG. 21A shows the structure of one face of the membrane valve that is opposed to the partitioning wall, while FIG. 21B shows the structure of one face of the partitioning wall that is opposed to the membrane valve.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1:
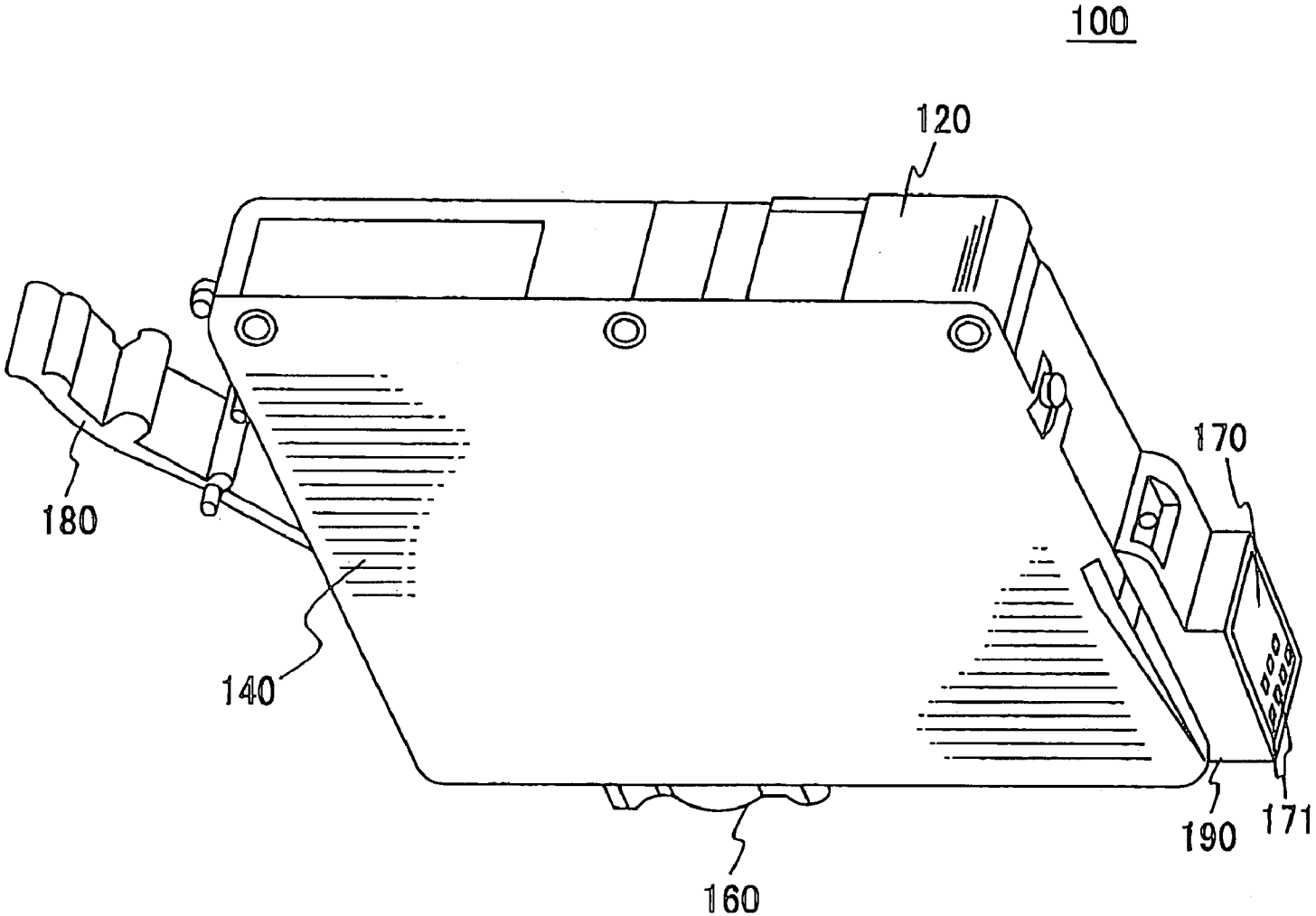
FIG. 1 shows a front perspective view of an ink cartridge according to an embodiment of the present invention.

FIG. 1 is a front perspective view of an ink cartridge 100 of an ink-jet recording apparatus as an exemplary liquid cartridge suitable for supplying liquid to a liquid ejection head of a liquid ejecting apparatus. FIG. 1 shows the structure of the ink cartridge 100 seen obliquely from above.

The liquid ejection head of the liquid ejecting apparatus of the present invention includes not only the ink-jet head of the ink-jet recording apparatus but also a color-material ejecting head used for fabrication of a color filter for a liquid crystal display or the like, an electrode-material (conductive paste) emitting head used for forming an electrode in an organic EL display or a field-emission display (FED), a bioorganic compound emitting head used for fabrication of a bio-chip and a sample spraying head as a precision pipette.

Figure 2:
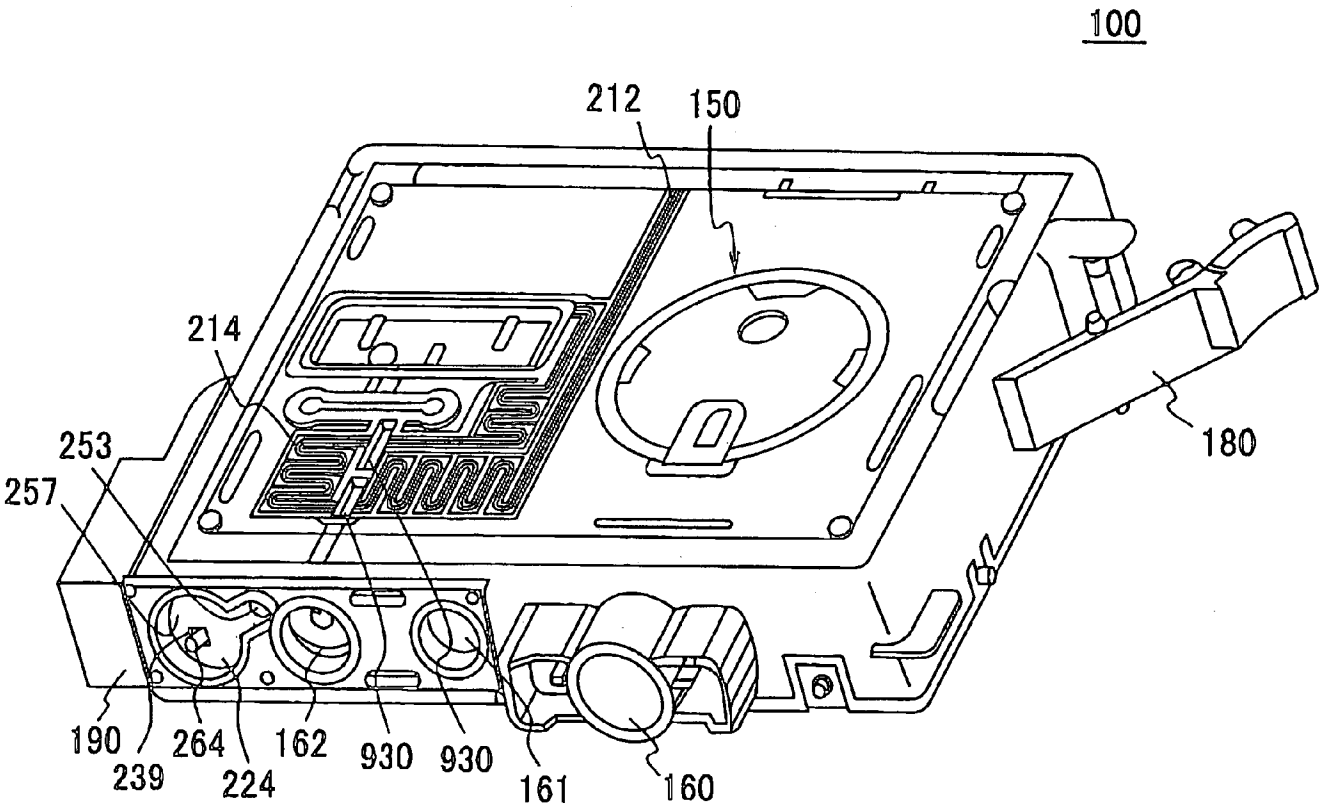
FIGS. 2 and 3 shows rear perspective view of the ink cartridge shown in FIG. 1.
Figure 3:
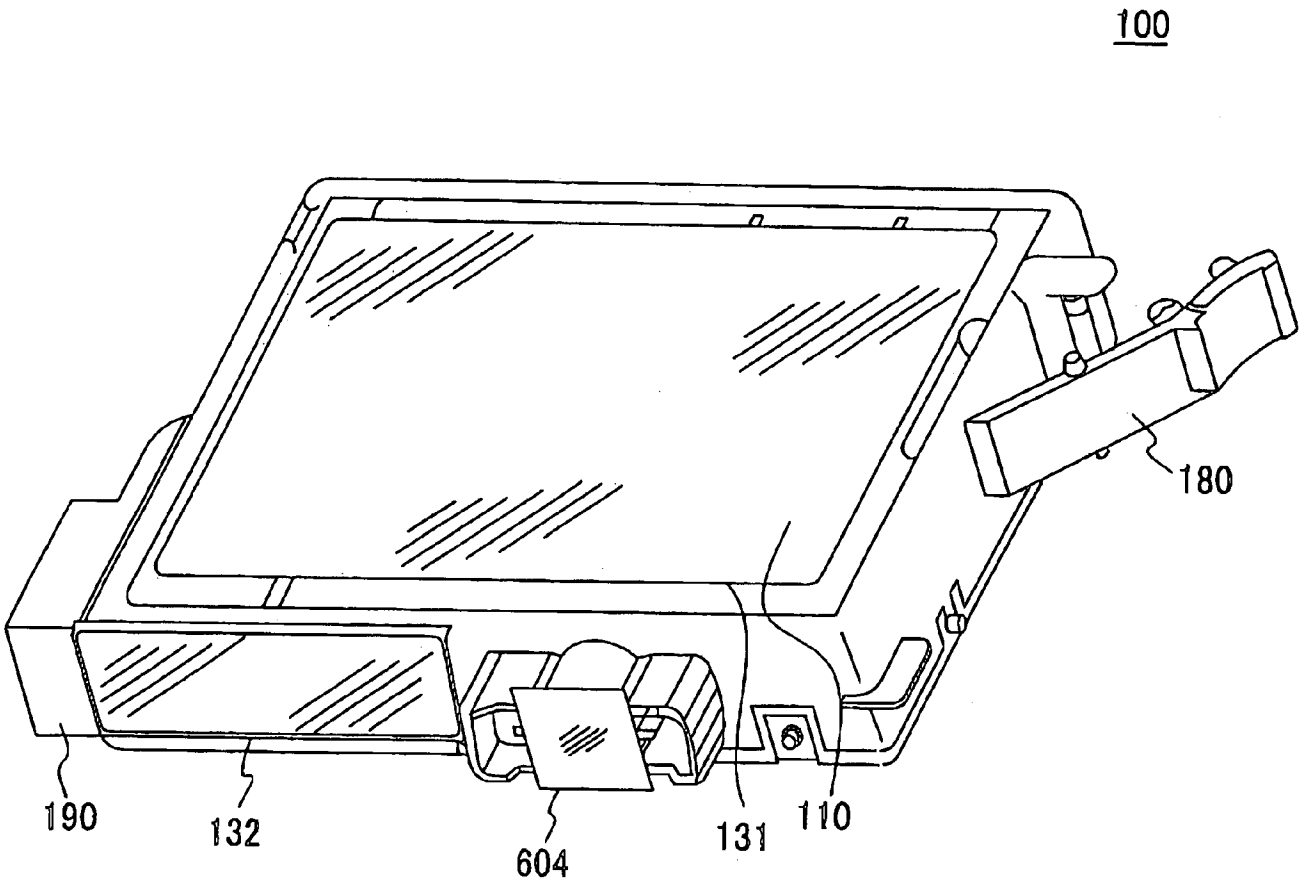

FIGS. 2 and 3 are rear perspective views of the ink cartridge 100 shown in FIG. 1 seen obliquely from beneath. FIG. 2 shows a state before a film 110 is put on the surface of the ink cartridge 100 to adhere thereto and FIG. 3 shows a state after the film 110 is put on the ink cartridge 100. Moreover, FIGS. 4 and 5 are exploded views of the ink cartridge 100, showing parts constituting the ink cartridge.

Figure 4:
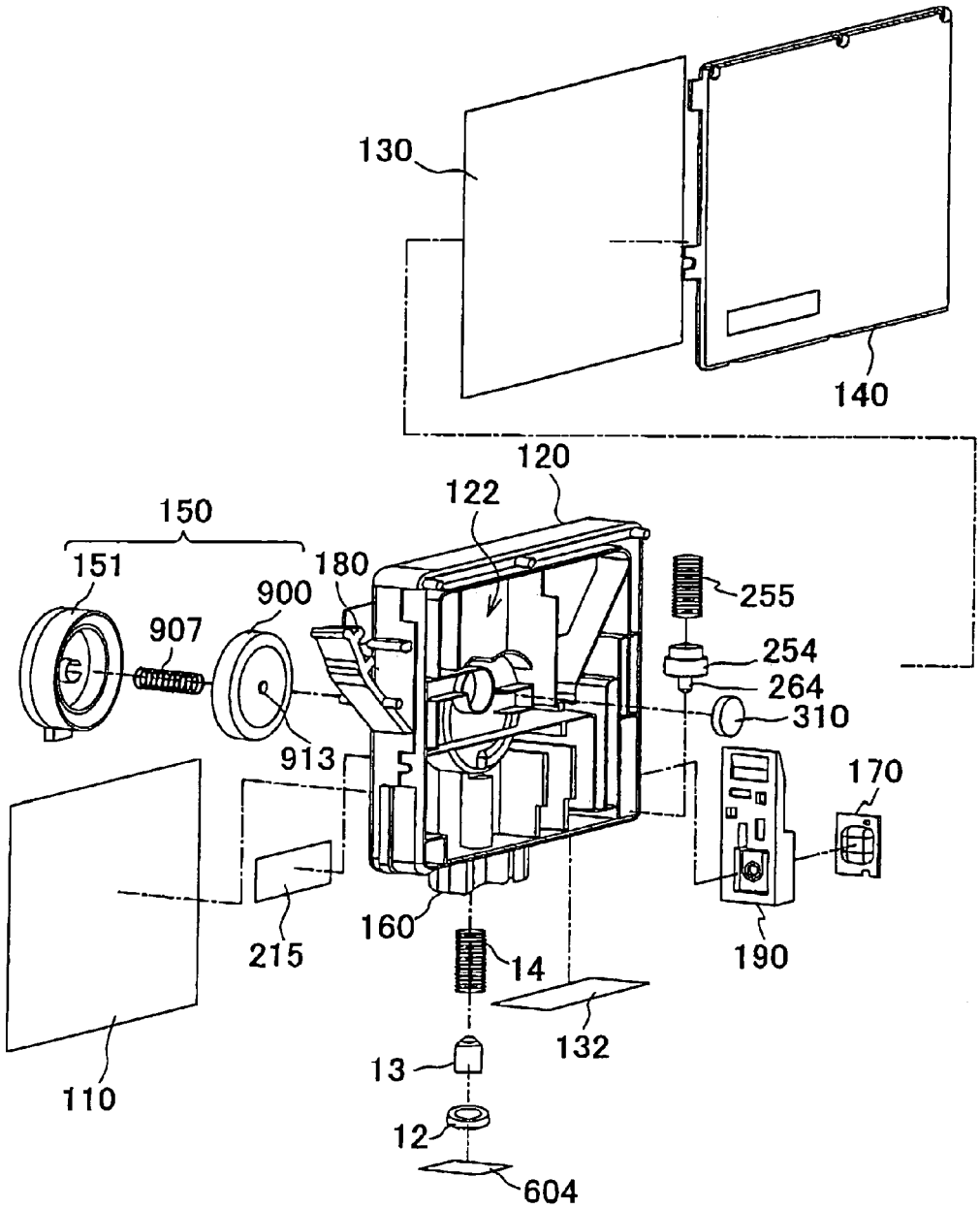
FIG. 4 shows an exploded view of the ink cartridge shown in FIG. 1, seen from one side thereof.
Figure 5:
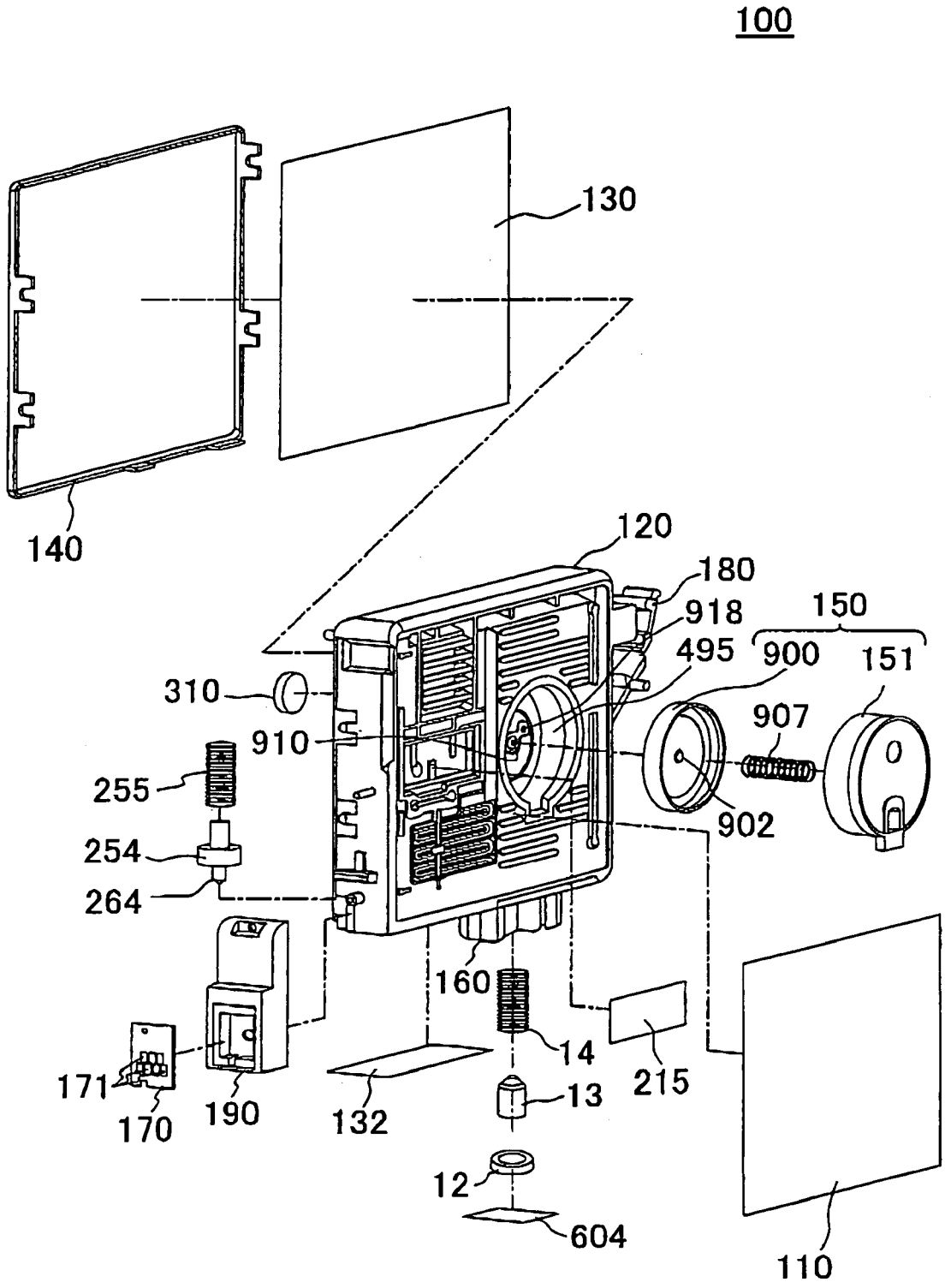
FIG. 5 shows another exploded view of the ink cartridge shown in FIG. 1, seen from another side thereof.

As shown in FIG. 4, the ink cartridge 100 includes a cartridge body 120 that is a housing with a bottom in which an opening 122 is provided in its one side face, a film 130 for covering the opening 122 substantially entirely and a cover 140 for covering the outer surface of the film 130. The inside of the cartridge body 120 is divided by a rib and a wall, as described later. The film 130 seals the inside of the cartridge body 120 by covering the opening 122 substantially entirely. The cover 140 is secured to cover the outer surface of the film 130 in a non-sealing manner.

The cartridge body 120 includes an ink flowing portion formed by an ink accommodating region and an ink flow path and an air-communication section formed by an ink-side passage 230 that communicates the ink accommodating region with ambient air, an air-valve accommodating portion and an air-side passage 210.

Figure 6:
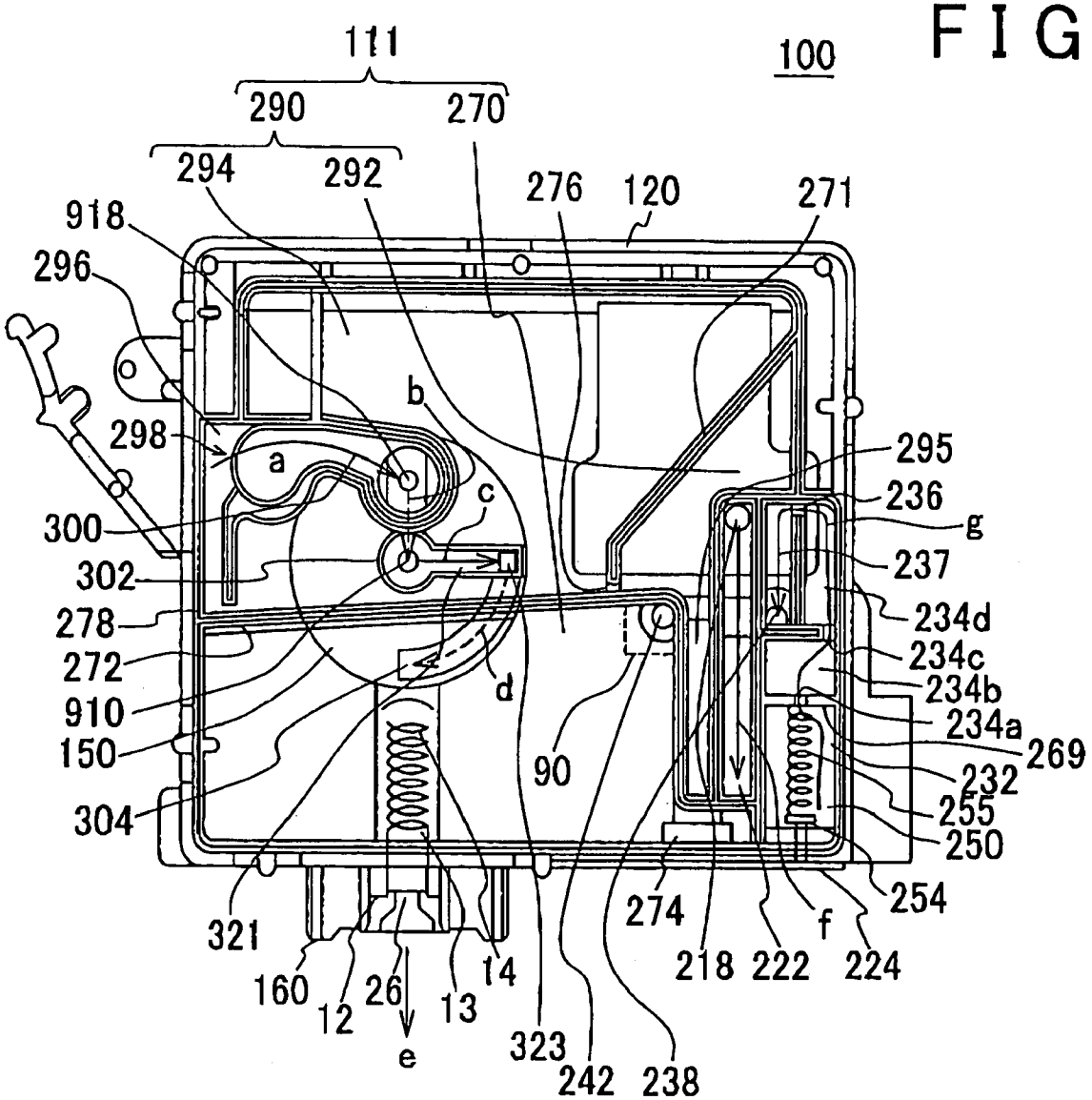
FIG. 6 is a plan view of a cartridge body in a state where a film for sealing the opening is removed, seen from the opening-side of the cartridge body.
Figure 7:
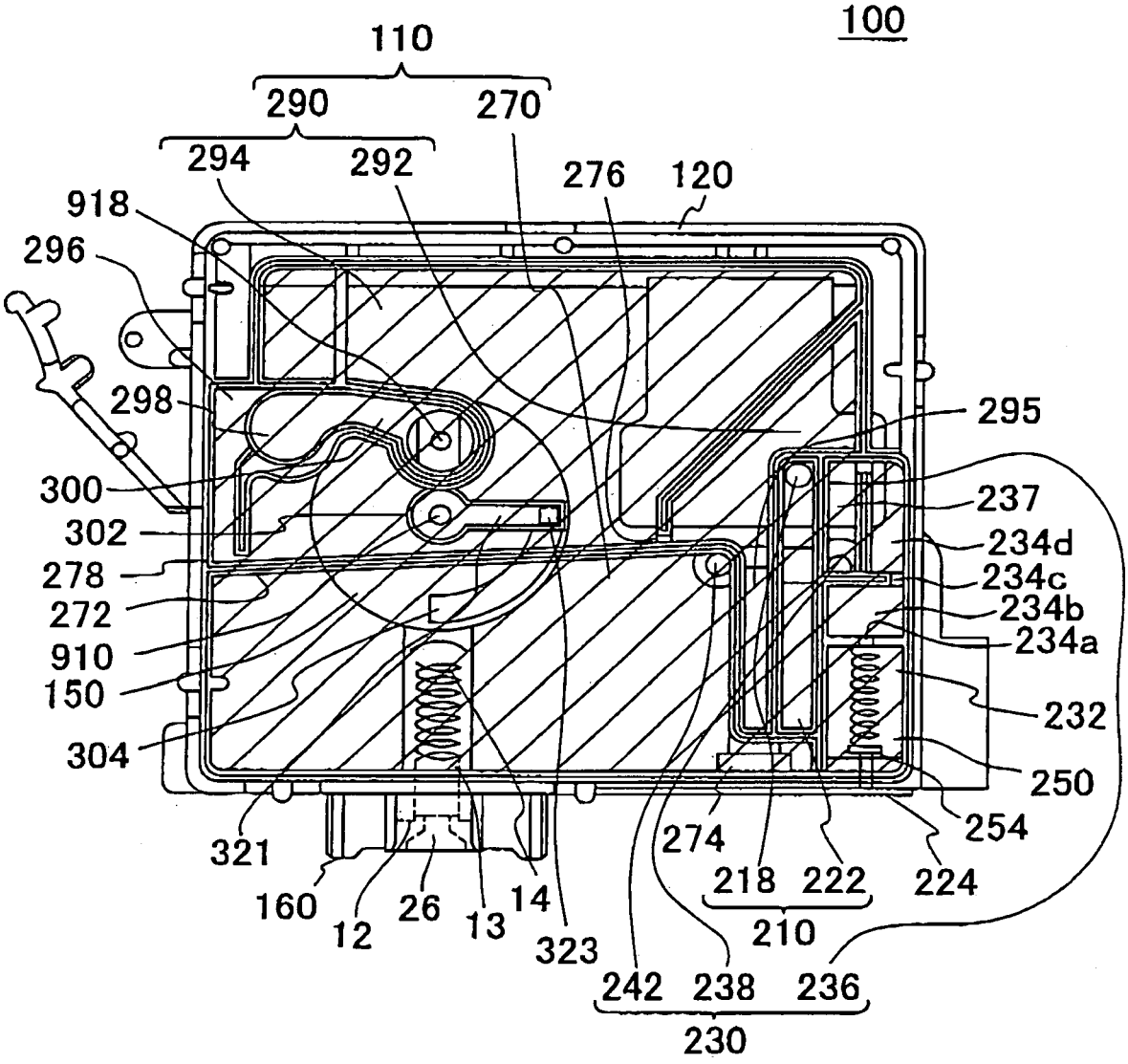
FIG. 7 is a plan view of the cartridge body, seen from the opening-side thereof.

FIGS. 6 and 7 explain the inside of the cartridge body 120. FIG. 7 shows a state where the opening of the cartridge body 12 is sealed with the film 130. The region covered by the film 130 is shown with hatching in FIG. 7.

The ink accommodating region is divided into upper and lower portions by a wall 272 that extends in the horizontal direction, as shown in FIGS. 6 and 7. The lower portion includes an atmospheric-side accommodating chamber 270 that can communicate with ambient air via a communication hole 242. The upper part includes a liquid-supply-side accommodating chamber 290 formed by the first and second ink accommodating chambers 292 and 294 that are shielded from ambient air. The liquid-supply-side accommodating chamber 290 is divided into two by an oblique wall 271 having a communication section 276 near the wall 272 (near the lower portion), thereby the first and second ink accommodating chambers 292 and 294 are formed. Moreover, a flow path 296 is formed to be surrounded by the second ink accommodating chamber 294. The flow path 296 connects with the second ink accommodating chamber 294 via a communicating part 278 formed at a lower portion of the flow path 296 and also connects with an ink-supply controlling means 150 including a differential pressure regulating valve having a membrane valve detailed later, via passages 298 and 300 and a communication hole 918.

In the downstream of the ink-supply controlling means 150, a communicating hole 910 that is in communication with the ink-supply controlling means 150, a flow path 321 that is in communication with the communication hole 910, a communication hole 323 formed at one end of the flow path 321 to face the surface of the cartridge body 120, a flow path 304 having an end that communicates with the communication hole 323, and an ink supply port 160 that communicates with the flow path 304 are formed, as shown in FIG. 6. The ink supply port 160 includes an opening which is closed by a seal 160 before mounting on the holder of the carriage of the ink jet printing apparatus as shown in FIG. 3, while FIG. 2 shows the ink supply port 160 in a state that the seal 160 is peeled off.

The atmospheric-side accommodating chamber 270 and the first ink accommodating chamber 292 are in communication with each other via a communicating passage 295 extending vertically, and takes ink accommodated in the atmospheric-side accommodating chamber 270 into the first ink accommodating chamber 292 in accordance with the ink consumption in the ink supply port 160. The thus taken ink is then made to flow to the ink-supply controlling means 150 via the second ink accommodating chamber 294, the flow path 296 and the like.

On the other hand, an atmospheric valve section 250 includes a hollow part 232 that serves as an atmospheric valve accommodating section in which an atmospheric valve 254 is accommodated. The atmospheric valve section 250 also includes a communication hole 239 as shown in FIG. 2 having a diameter slightly larger than the diameter of the axis 264 of the atmospheric valve 254, which also serves as a flow path. The axis 264 of the atmospheric valve 254 is always biased toward the bottom of the cartridge by a coil spring 255 in such a manner that the axis 264 of the atmospheric valve 254 can be slidably inserted into the communication hole 239. Thus, the atmospheric valve 254 seals the communication hole 239 when the cartridge is not mounted in the body of the ink-jet recording apparatus.

As shown in FIG. 7, the region shown with hatching is sealed with the film 130, thereby an ink accommodating chamber 111 formed by the atmospheric-side accommodating chamber 270 and the liquid-supply-side accommodating chamber 290, the atmospheric valve section 250 and an ink flow path and an air passage that connect the ink accommodating chamber 111 and the atmospheric valve section 250 to each other.

Figure 8:
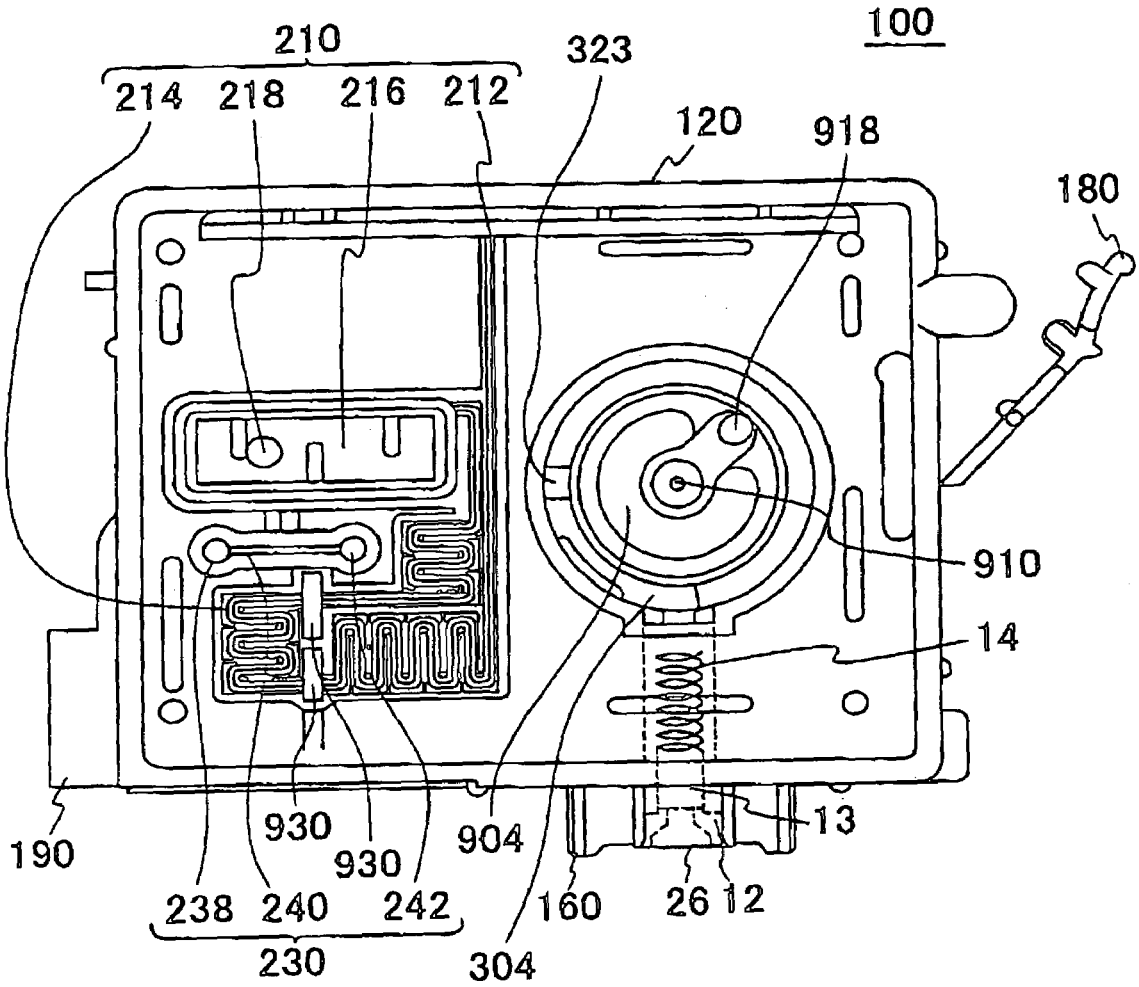
FIG. 8 is a plan view of the cartridge body in a state where a film-valve holding member and a film are removed, seen from the front-side of the cartridge body.

Referring to FIG. 8, an air-side passage 210, that is on one side of the aforementioned communication hole 239 which communicates with ambient air, is formed by an opening 212, a passage 214 which is circuitous or winding, a filter accommodating portion 216, a communication hole 218 and a communication section 222, a communication hole 253 (shown in FIG. 2) formed on the bottom of the communication section 222 and a communication section 224.

More specifically, as shown in FIG. 8, a single circuitous passage 214 formed on the front side of the cartridge body 120 like a maze is opened to ambient air at one end, i.e., the opening 212. The other end of the circuitous passage 214 is connected to the filter accommodating portion 216 that accommodates a filter 215 (shown in FIGS. 4 and 5) having functions of repelling ink and breathability. The filter accommodating portion 216 communicates with the communication hole 218 that extends through from the front side to the back side of the cartridge body 120. The communication hole 218 connects with the communication section 224 through the communication section 222 on the backside of the cartridge body 120 and the communication hole 253 formed on the bottom of the communication portion 222. On the way of the passage 214, a chamber 930 in form of a recess is provided. Due to the chamber 930, fluid resistance in the passage 214 can be decreased as compared to that in a case where no chamber is formed, so that it is possible to remove the reduced pressure inside the cartridge at the first use of the liquid cartridge. Moreover, in a case where ink leaked to enter the passage 214 when the filter 215 is insufficiently secured in the filter accommodating portion 216, it is possible to trap the ink so as to prevent further leak of the ink to the outside.

The communication section 224 is formed as a recess 257 on the bottom of the cartridge body 120, as shown in FIG. 2. In the recess 257, the communication hole 239, that exposes the axis 264 of the atmospheric valve 254 serving as an operation yoke and can communicate with the hollow, atmospheric valve accommodating section 232 accommodating the atmospheric valve 254, and the communication hole 253 communicating with the communication section 222 are formed. The recess 257 is sealed by a film 132 for sealing the first ink inlet 161 and the second ink inlet 162.

As the film 132, a film that can be elastically deformed by a pressing force applied by an operation member 202 provided on the holder 200 is chosen.

On the other hand, the ink-side passage 230 that is one side of the communication hole 239, which communicates with the atmospheric-side accommodating chamber 270, is formed by the atmospheric valve accommodating section 232, a communication hole 234*a*, a communication chamber 234*b*, a communication section 234*c*, a communication chamber 234*d*, a communication section 236, a communication chamber 237, a communication hole 238, a communication groove 240 and a communication hole 242.

Referring to FIGS. 6 and 7, the structure of the ink-side passage 230 is described in more detail. In the upper wall of the atmospheric valve accommodating section 232, the communication hole 234*a* is formed. An air passage is formed by: the communication chamber 234*b* in communication with the communication hole 234*a*, the communication section 234*c* formed by cutting a portion of the upper wall of the communication chamber 234*b*, the communication chamber 234*d* in communication with the communication section 234*c*, the communication section 236 formed by cutting a portion of the upper wall of the communication chamber 234*d* and the communication chamber 237 having the communication hole 238 at the lower part thereof. Please note that bold arrows A and B in FIG. 6 represent the direction in which air flows from the ambient air side to the atmospheric-side accommodating chamber 270, in that order.

The communication hole 238 extending from the back side of the cartridge body 120 to the front side thereof communicates with the atmospheric-side accommodating chamber 270 via the communicating groove 240 (FIG. 8) in communication with the communication hole 238 and a communication hole 242 that communicates with the communicating groove 240 and extends from the front side to the back side of the cartridge body 120.

The atmospheric-side accommodating chamber 270, the liquid-supply-side accommodating chamber 290, the atmospheric valve section 250, the air-side passage 210 and the ink-side passage 230 mentioned above are isolated from ambient air by putting the films 130, 110 on the walls for sectioning the above-mentioned portions and passages to adhere thereto by heat.

Figure 9A:
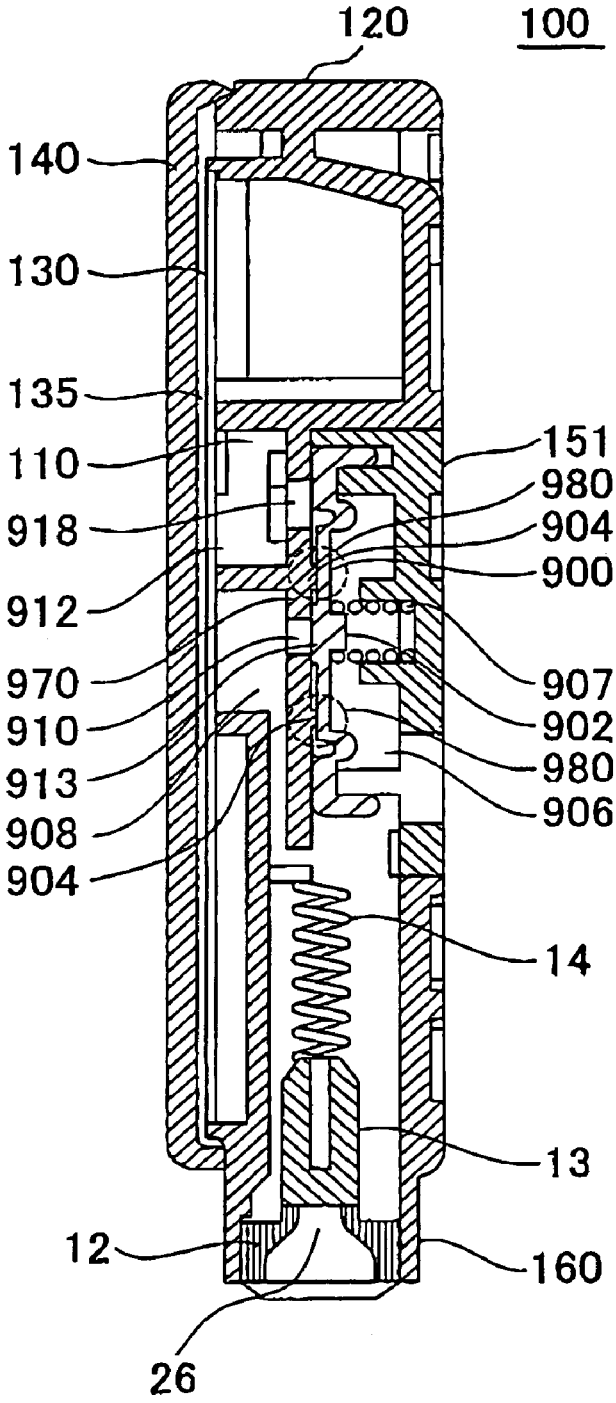
FIG. 9A is a cross-sectional view showing a region near a supply member of the ink cartridge shown in FIG. 1.
Figure 9B:
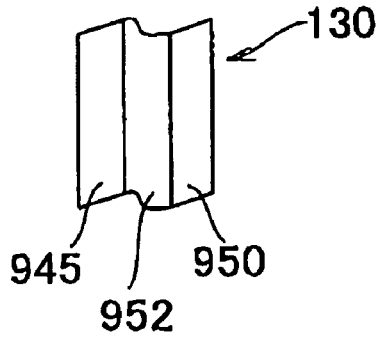
FIG. 9B is a cross-sectional view of an exemplary film for sealing the opening of the cartridge body.

The structure of the film 130 is shown in FIG. 9B. As shown in FIG. 9B, the film 130 includes three layers, i.e., an innermost layer 950, a strengthening layer 952 and an anti-permeation layer 954. The film 130 can be elastically deformed to a some degree by a differential pressure between the pressure in the atmospheric-side accommodating chamber 270, the liquid-supply-side accommodating chamber 290, atmospheric valve section 250 and the air-side passage 210, and atmospheric pressure.

The innermost layer 950 is arranged to be contact with the ink-accommodating region. Therefore, it is desirable that the innermost layer 950 be formed from the same material as that of the cartridge body 120, for example, polypropylene. By forming the innermost layer 950 from the same material as that of the cartridge body 120, it is possible to make the film 130 reliably adhere to the opening of the cartridge body 120 by heat.

The strengthening layer 952 is formed as an intermediate layer to be higher in strength than the innermost layer 950, in order to reinforce the innermost layer 950. The anti-permeation layer 954 is provided for preventing permeation of ink vapor or air and maybe formed of polyethyleneterephthalate (PET), for example.

Figure 10A:
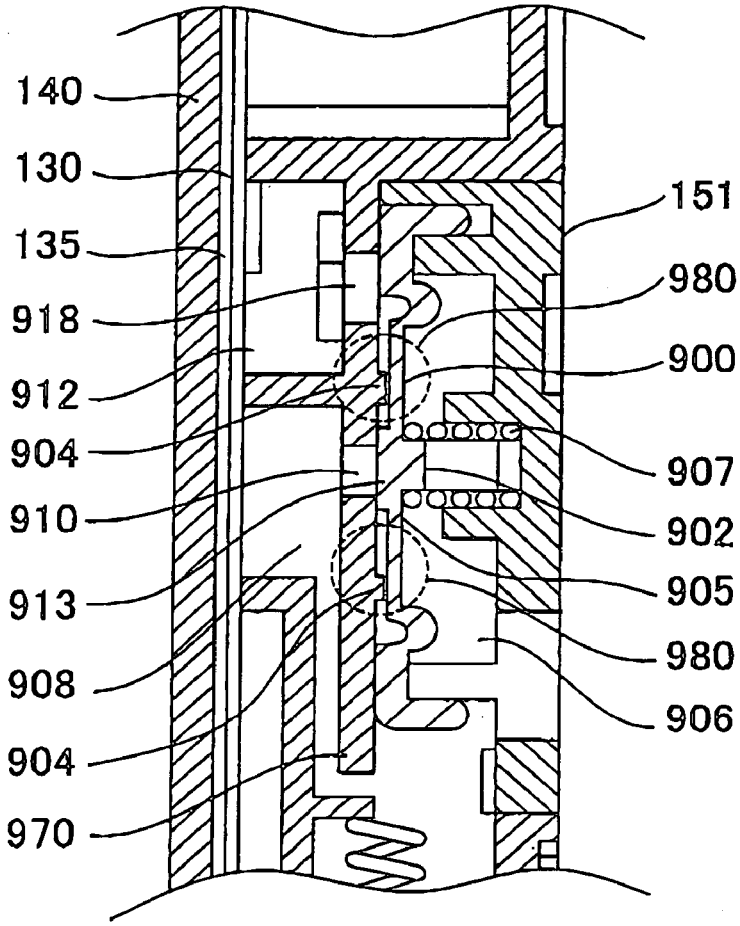
FIG. 10A is a cross-sectional view of an exemplary supply controlling portion.

As shown in FIG. 10A, on the outer surface of the film 130, the cover 140 is fitted to be closely contact with the outer surface of the film 130 in such a manner that the volume between the film 130 and the cover 140 is reduced as small as possible, thereby preventing undesirable expansion of the film 130 when the ink cartridge is packed in a vacuum bag 101 described later and breakage of the film 130 by a projection or the like.

Next, the ink supply port 160 of the cartridge body 120 is described. As shown in FIG. 9A, the ink supply port 160 includes a supply valve 13 that is slidable by being pressed by an ink-supply needle of the holder to be opened, a sealing member 12 provided to be fitted to surround the ink-supply needle, that has an insertion port 26, and a biasing member 14 formed by a coil spring for pressing the supply valve 13 toward the sealing member 12. The supply valve 13, the sealing member 12 and the biasing member 14 are assembled in the following manner. The biasing member 14 is attached into the cartridge body 120, and then the sealing member 12 is fitted in the ink supply port 160. Finally, the supply valve 13 is pushed inside the ink supply port 160 from the insertion port 26. In this way, a process for holding the spring is not required in the assembly. The assembly can be done only by mounting the components of the ink supply port 160.

Returning to FIG. 1, the ink cartridge 100 includes a positioning block 190 attached to one side face thereof, for positioning the ink cartridge 100 on a predetermined position on the holder. On the front face of the positioning block 190, a circuit board 170 is provided at a lower position of the block 190. The circuit board 170 includes electrodes 171 on the front surface and a semiconductor memory device mounted on the back surface. The memory device of the circuit board 170 stores identification information about a type of ink cartridge or the like, information on color of ink currently held by the ink cartridge, information on the residual amount of the ink, and the like.

Figure 13:
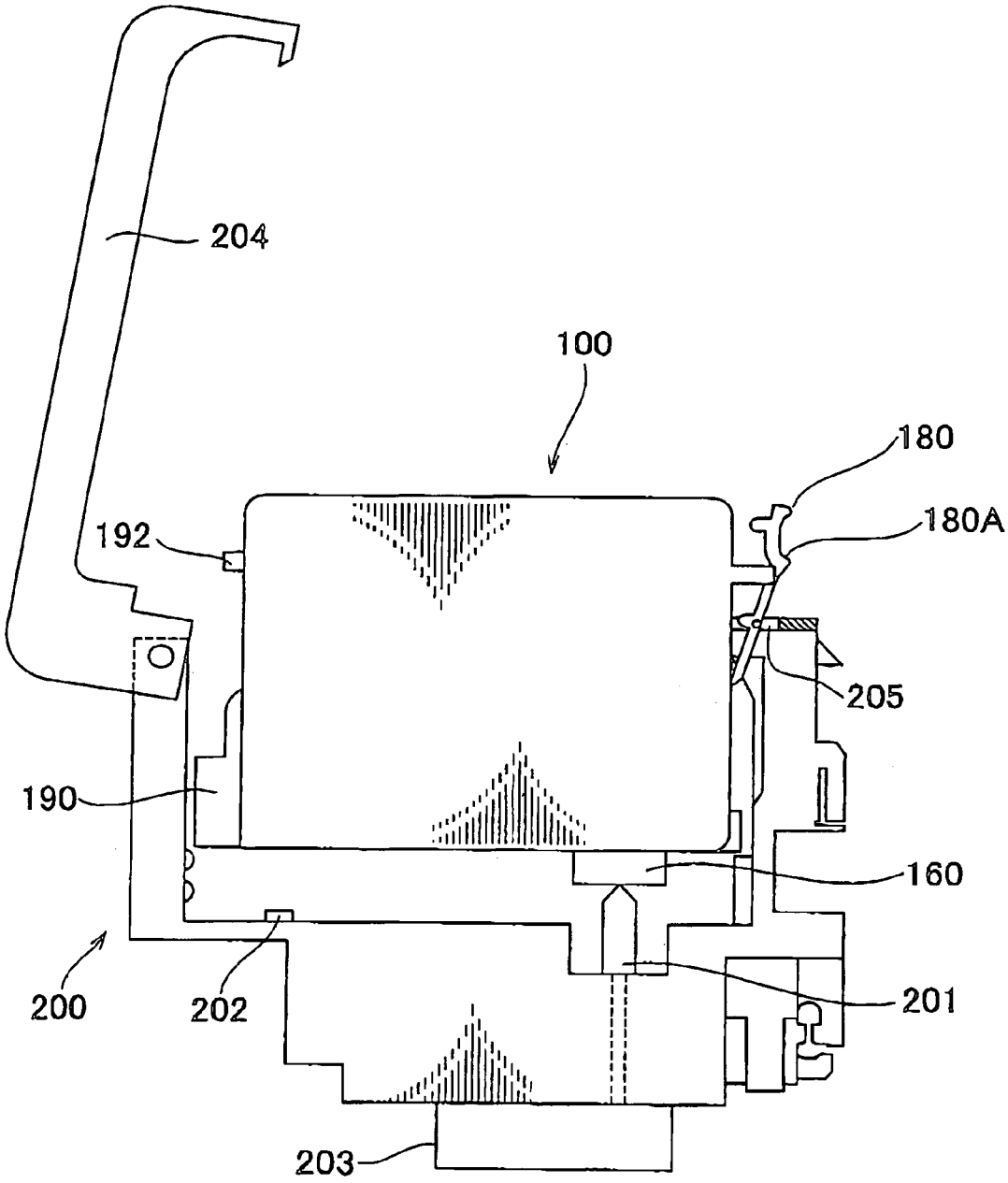
FIG. 13 shows a state in which the ink cartridge according to the present invention is mounted onto a holder.
Figure 14:
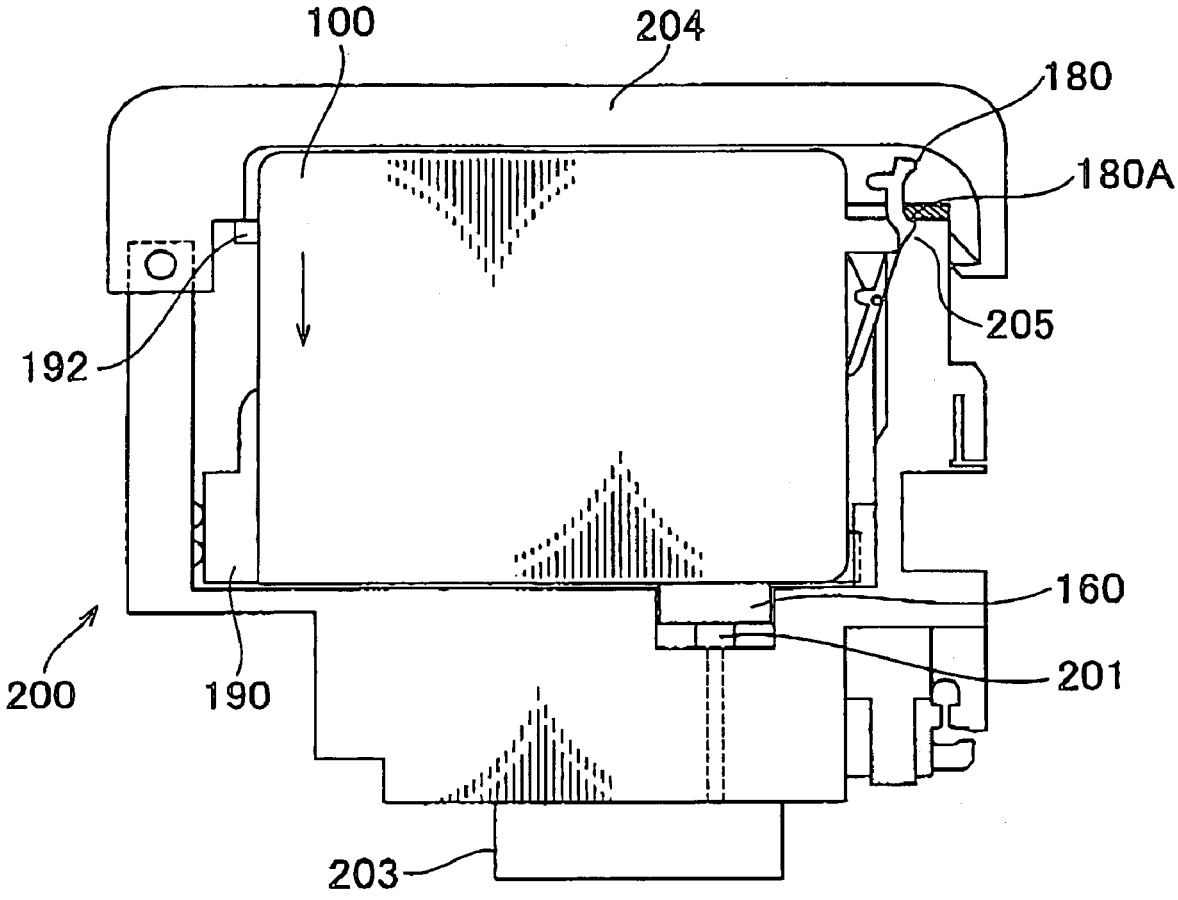
FIG. 14 shows a state in which the ink cartridge according to the present invention is loaded.
Figure 15A:
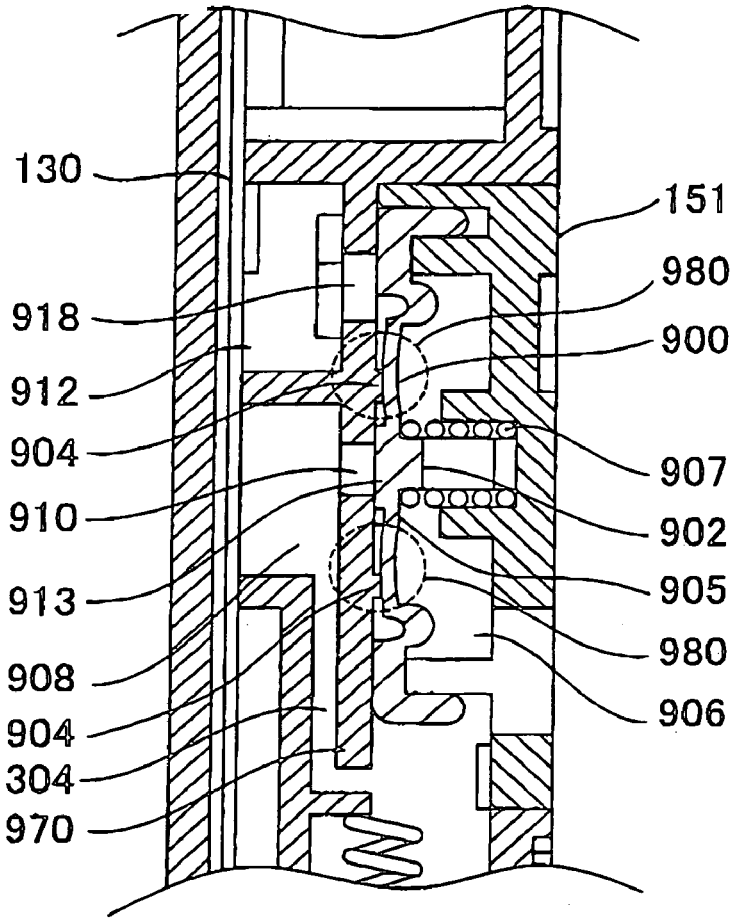
FIG. 15A is a cross-sectional view showing the shape of the membrane valve at a time at which the ink cartridge according to the present invention has been mounted onto the holder.
Figure 15B:
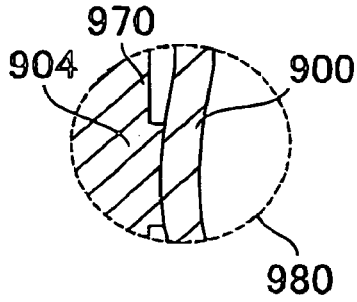
FIG. 15B is an enlarged cross-sectional view of the deformation regulating portion at the time when the ink cartridge according to the present invention has been mounted onto the holder.

A projection 192 may be provided in the upper part of the positioning block 190, which can engage with a lever 204 of the holder 200 described later to press the ink supply port 160 toward the holder 200, as shown in FIGS. 13 and 14.

On the other hand, an engagement member 180 formed by a lever that can engages with an engaging portion 205 of the holder 200 at a protrusion 180A (FIGS. 13 and 14) is provided on the opposite side face of the ink cartridge 100 to the side face on which the positioning block 190 is provided. The engagement member 180 is formed integrally with the cartridge body 120 in injection molding of the cartridge body 120.

FIG. 10A shows an exemplary ink-supply controlling means 150. The ink-supply controlling means 150 includes a partition wall 970, a membrane valve 900, a body-side communication chamber 912, supply-side communication chambers 906, 908, a deformation regulating portion 980 and a coil spring 907. The ink-supply controlling means 150 is secured to the cartridge body 120 by a holding member 151.

The partitioning wall 970 is arranged between the atmospheric-side accommodating chamber 270 and the ink supply port 160 and sections the body-side communication chamber 912 formed on the side that communicates with the ink accommodating chamber 111 and the supply-side communication chambers 906 and 908 that communicate with the ink supply port 160. The partitioning wall 970 includes a communication hole 910 and a communication hole 918 that connect the flow path 296 to the ink supply port 160.

Figure 11:
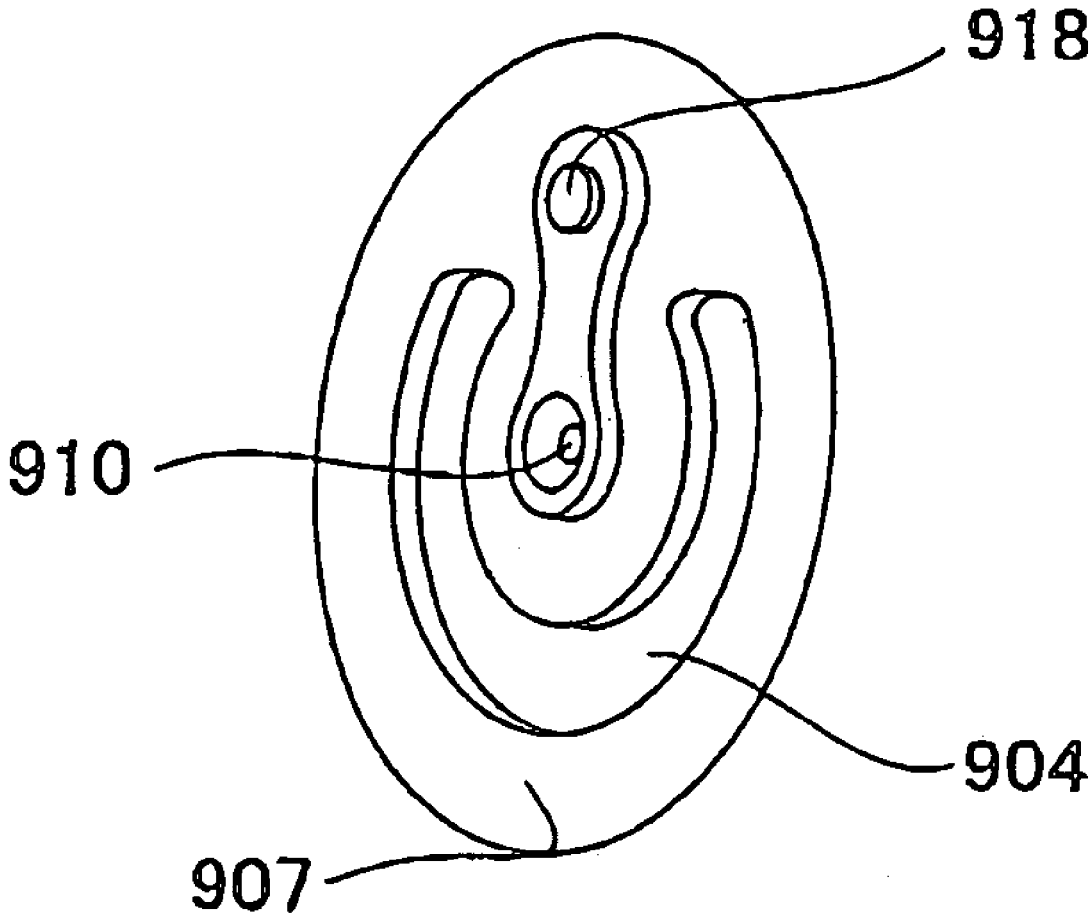
FIG. 11 is a perspective view of an exemplary deformation regulating portion as the structure of a partitioning wall.

The communication hole 910 is formed around the center of the partitioning wall 970 while the communication hole 918 is formed in the periphery of the partitioning wall 970. On the face of the partitioning wall 970 opposed to the membrane valve 900, the deformation regulating portion 980 formed by an approximately annular ridge 904 having its center at the communication hole 910 and a cut portion in the region of the communication hole 918, as shown in FIG. 11.

Figure 10B:
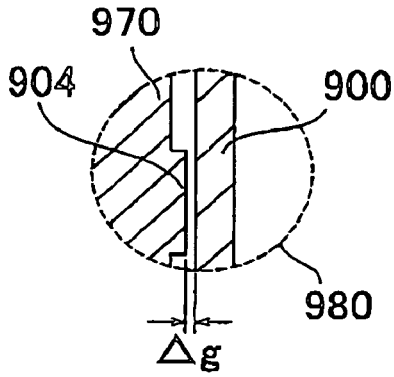
FIG. 10B is an enlarged cross-sectional view of a part of the supply controlling portion, showing a deformation regulating portion.

The ridge 904 serving as the deformation regulating portion 980 has the height smaller than the height of the projection 913 of the membrane valve 900. Moreover, the height of the ridge 904 is set to form a gap $\Delta g$ (shown in FIG. 10B) so as to allow the projection 913 of the membrane valve 900 to reliably seal the communication hole 910.

The membrane valve 900 is formed to be circular from material that can be deformed elastically, such as elastomer. Around the center of the membrane valve 900, the projection 913 is formed for coming into contact with the communication hole 910 to seal the communication hole 910. The membrane valve 900 is biased toward the communication hole 910 by the spring 907 attached to a projection for spring attachment 902 provided on the back side of the membrane valve 900. As the biasing force, a pressing force that allows the ink supply port 160 to maintain a constant negative pressure is applied. Since the force applied by the spring 907 acts on the projection 902 provided on the back of the projection 913, it is possible to prevent deformation of the periphery of the membrane valve 900 so as to keep the membrane valve 900 substantially flat, thus preventing the increase of fluid resistance.

In the ink cartridge 100 having the above structure, a connector is inserted into the ink supply port 160 to press the supply valve 13 inside. In this manner, the supply valve 13 is opened, so that air in the inside of the cartridge is discharged. This discharge of air causes displacement of the membrane valve 900 against the spring 907, thereby reducing the pressure in the liquid-supply-side accommodating chambers 292 and 294. In this state, when ink is injected from the first ink inlet 161, the ink is drawn into the liquid-supply-side accommodating chambers 292, 294 and the flow path so that the liquid-supply-side accommodating chambers 292, 294 and the flow path are filled with the ink. Moreover, when ink is injected from the second ink inlet 162, the ink flows into the atmospheric-side accommodating chamber 270. When the ink filling is finished, a seal 604 is put on the ink supply port 160 to adhere thereto. Moreover, a seal 132 is placed on the first ink inlet 161 and the second ink inlet 162 to adhere thereto under reduced pressure. In this manner, the inside of the cartridge can be sealed to have a pressure lower than atmospheric pressure.

Figure 12:
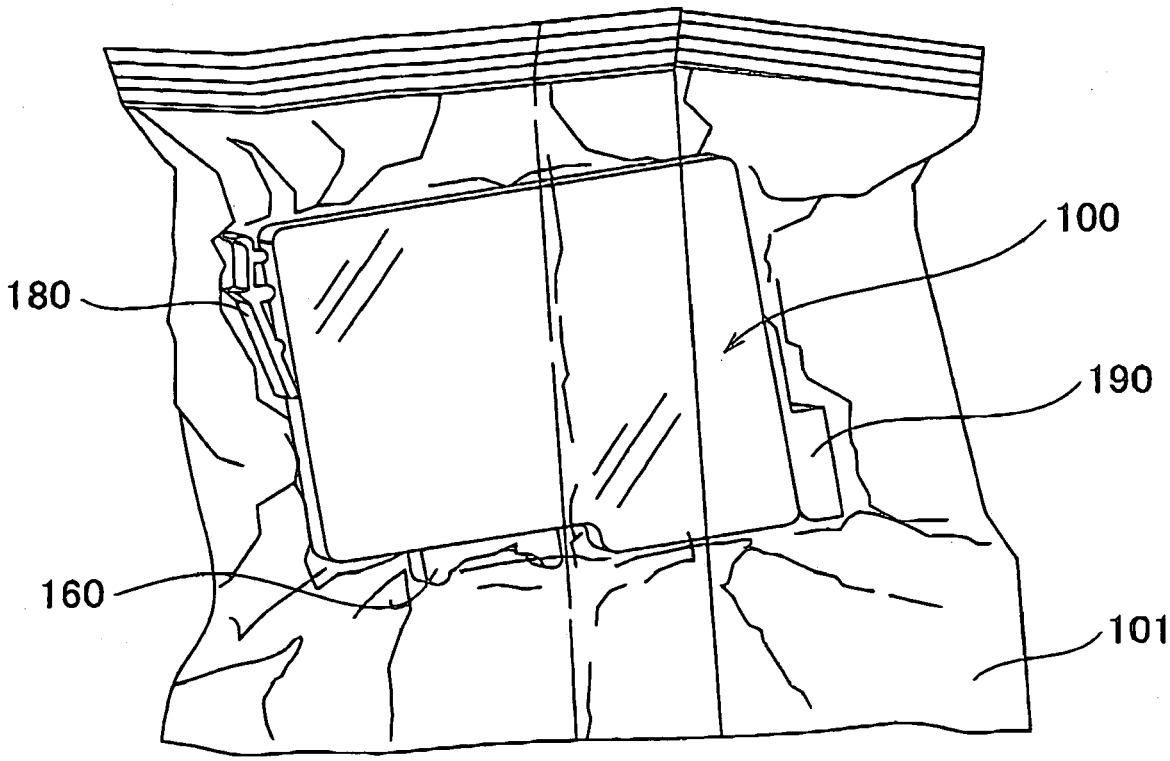
FIG. 12 is a perspective view of the ink cartridge according to the present invention packaged in a vacuum bag.

Then, the cartridge is put into a vacuum bag 101, and thereafter the opening of the vacuum bag 101 is sealed under reduced pressure lower than the pressure in the inside of the cartridge. In this manner, the cartridge is packaged under reduced pressure, as shown in FIG. 12.

In this state, the ink accommodating chamber 111 is isolated from the outside by the atmospheric valve 254 so that the ink accommodating chamber 111 is not in communication with the outside. Therefore, the film 130 that seals the opening of the cartridge body 120 expands. However, since the cover 140 is in close contact with the film 130, the film 130 is regulated by the cover 140. Thus, the amount of expansion of the film 130 to the outside can be suppressed as small as possible.

Since the film 130 slightly expands as described above, the negative pressure in the vacuum bag 101 acts on all the ink in the ink accommodating chamber 111 through the film 130, thus expelling of air from the ink proceeds. The ink cartridge 100 is distributed in this state. Therefore, until the start of the use of the ink cartridge, it is possible to maintain the pressure in the ink accommodating chamber to be lower than atmospheric pressure and keep the ink in the ink accommodating chamber in a state where air has been expelled, because air contained in the ink accommodating chamber gradually leaks to enter the space between the vacuum bag and the cartridge.

When the ink cartridge is put out from the vacuum bag 101 at the start of the use, atmospheric pressure acts on the film 130 of the ink cartridge. Therefore, the film 130 is elastically deformed toward the atmospheric-side accommodating chamber 270 by a differential pressure between the pressure in the atmospheric-side accommodating chamber 270 and atmospheric pressure, thereby reducing the degree of the negative pressure in the atmospheric-side accommodating chamber 270.

This can reduce the degree of drawing of meniscus formed at a nozzle opening of a liquid ejection head into the ink cartridge caused by the negative pressure within the ink cartridge when the ink cartridge is mounted on the holder 200, as shown in FIG. 14.

Especially in this example, the region forming the ink accommodating chamber is entirely sealed with the film 130. Therefore, the negative pressure can be removed (i.e., the pressure can increase) more quickly as compared to a case where the ink accommodating chamber is partially sealed with the film 130.

Next, a case where the aforementioned film 130 is not used or a case where the negative pressure cannot be removed (i.e., the pressure cannot increase) sufficiently because of restriction by the selection of the film 130 or the like is described. The following description also relates to the structure that is effective for removing the negative pressure more reliably.

When the ink cartridge is mounted on the holder 200 as shown in FIG. 13, and is then loaded by rotating a lever 204 as shown in FIG. 14, the ink-supply needle 201 enters the ink supply port 160 and then the atmospheric valve 254 is opened by the operation member 202 on the bottom of the holder 200.

At a time at which the ink-supply needle 201 has come into contact with the ink supply port 160, the back face of the membrane valve 900 is in communication with ambient air via the liquid ejection head 203 communicating with the ink-supply needle 201. Since the pressure in the ink accommodating chamber is low at this time, atmospheric pressure acts on the membrane valve 900 in the direction toward the ink supply port 160 so as to cause elastic deformation of the membrane valve 900 toward the partitioning wall 907. However, the membrane valve 900 comes into contact with the deformation regulating portion 980 formed on the partitioning wall 970, thereby being stopped at a predetermined position.

This deformation amount approximately corresponds to the gap Δg in this example, which is considerably small as compared to a case where no deformation regulating portion 980 is formed, because the deformation regulating portion, i.e., the ridge 904 on the partitioning wall 970 in this example suppresses the deformation of the membrane valve 900. Therefore, meniscus at the nozzle opening of the liquid ejection head 203 is stopped at such a position that it has no effect on formation of liquid drops although the meniscus is drawn slightly.

Moreover, it can be considered that the membrane valve 900 is formed so as to allow the periphery of the membrane valve 900 to come into contact with the partitioning wall 970 by slight displacement of the membrane valve 900, by reducing the height of the projection 913 of the membrane valve 900. However, in this case, there is a problem that the gap between the partitioning wall 970 and the membrane valve 900 becomes smaller to increase the fluid resistance of ink, thus reducing the capability of ink supply. There is another problem that the cost is increased because the dimension of the projection 913 should be controlled with high precision.

When ink is consumed in the liquid ejection head 203 after the cartridge 100 is completely mounted, the pressure on the ink supply portion side of the ink-supply controlling means 150 is reduced to a predetermined pressure or less. Thus, the membrane valve 900 forming the ink-supply controlling means 150 receives the negative pressure of the ink supply port 160 in a larger area on its back. In addition, although the negative pressure of the ink supply port 160 also acts via the communication hole 910, the displacement cannot be obstructed because the area of the opening of the communication hole 910 is significantly small as compared to the area of the back of the membrane valve 900.

When the negative pressure acting on the back of the membrane valve 900, i.e., the face of the membrane valve 900 on the side communicating with the supply port 160 overcame the spring 907, the membrane valve 900 goes away from the partitioning wall 970. Thus, ink in the flow path 296 flows into the film-valve side of the partitioning wall 970 via the communication hole 918 and then flows into the ink supply port 160 via the communication hole 910 in the partitioning wall 970 and the communication section or flow path 304. The ink flows into the supply port 160 without increase of the fluid resistance, because the ridge 904 is opened at the cut portion in the vicinity of the communication hole 918.

While air is drawn via the communication hole 242 into the atmospheric-side accommodating chamber 270, the ink in the atmospheric-side accommodating chamber 270 is drawn into the first liquid-supply-side accommodating chamber 292 via the communicating path 295 so that the second liquid-supply-side accommodating chamber 294 is refilled with the ink via the communication section 276.

When a predetermined amount of ink flowed into the ink supply port 160 in this manner and caused the differential pressure acting on the membrane valve 900 to become lower than the pressing force applied by the spring 907, the membrane valve 900 is pressed to go back toward the partitioning wall 970, thereby breaking the flow path of the ink.

By repeating the aforementioned processes, the pressure in the ink supply port 160 can be maintained to be a predetermined negative pressure so as to allow the ink to be supplied to the liquid ejection head.

Figure 16:
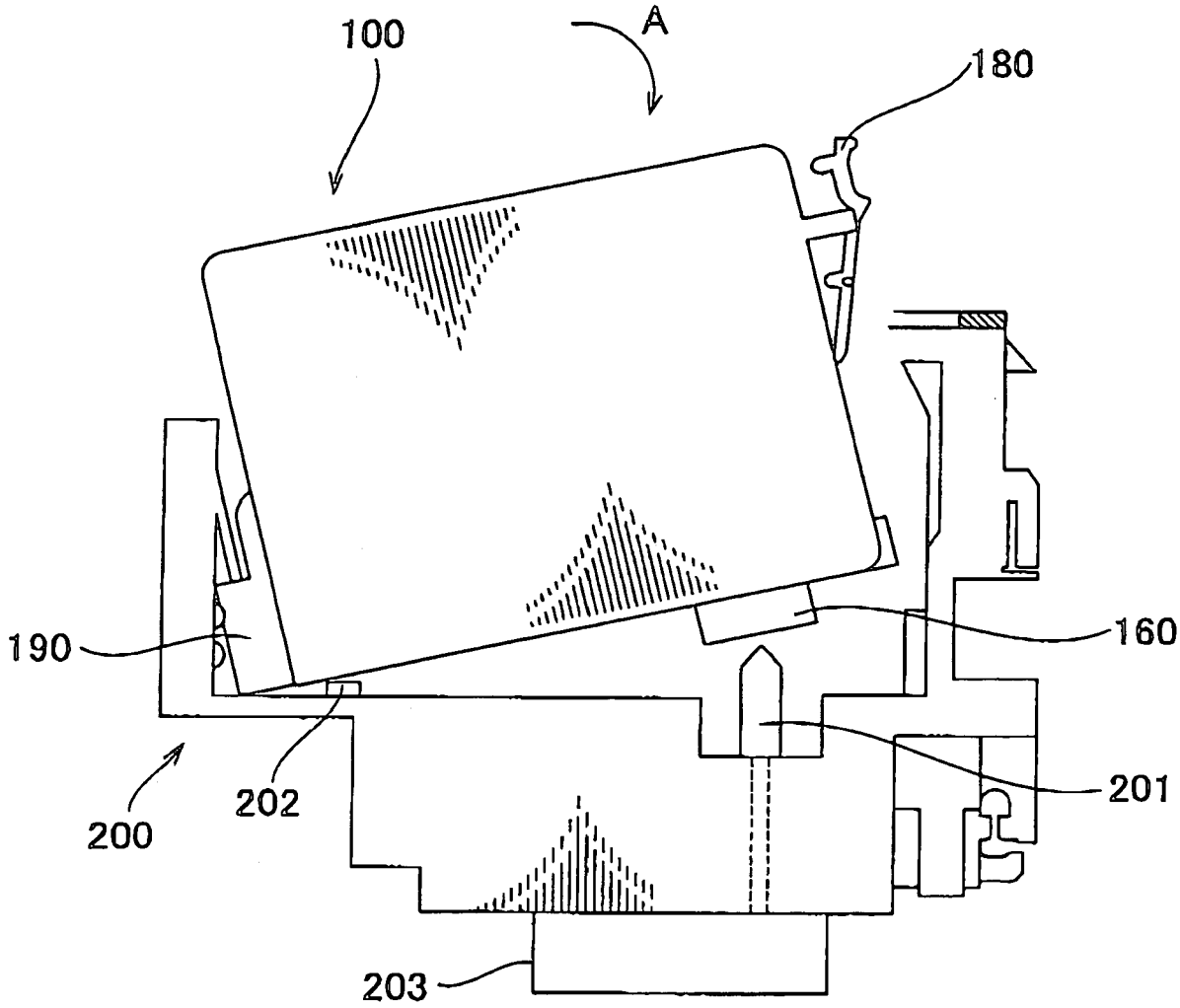
FIG. 16 shows another method of mounting the ink cartridge onto the holder.

In the above example, a case is described where the cartridge 100 is moved parallel to the ink-supply needle 201 to be mounted. Alternatively, as shown in FIG. 16, in a case where the cartridge 100 is arranged to place the positioning block 190 in its lower part and is mounted by being pivotally moved around this region as a fulcrum, it is possible to allow the atmospheric valve 254 to come into contact with the operation member 202 before the ink supply port 160 engages with the ink-supply needle 201, so as to open the ink accommodating chamber 111 to ambient air.

The above case is described in more detail. When the ink cartridge 100 has been mounted, air flows into the atmospheric-side accommodating chamber 270 from the air-side passage 210 via the ink-side passage 230 because the atmospheric valve section 250 has been opened. Thus, the reduced pressure in the ink cartridge 100 is removed. In this state, when the ink-supply needle of the ink-jet recording apparatus enters the ink supply port 160, the pressure on the ink-accommodating-portion side of the membrane valve becomes higher than that on the ink-supply-port side of the membrane valve because the reduced pressure inside the ink cartridge 100 has been already removed . Therefore, ink in the liquid ejection head can be prevented from being drawn or pulled back to the ink cartridge 100 and it is possible to reliably prevent the disadvantage that air is drawn from the nozzle opening of the liquid ejection head.

The present invention is effective in the apparatus having the above structure, in a case where opening to ambient air is delayed later than the insertion of the ink-supply needle into the ink supply port by inadequate mounting in which the cartridge is forced to be inserted in a direction parallel to the ink-supply needle, for example.

The deformation regulating portion is formed as the approximately annular ridge having the cut portion in the above example. However, the deformation regulating portion may be formed by a plurality of parts distributed on the face of the partitioning wall 970, that is opposed to the periphery portion 905 of the membrane valve 900, so as not to obstruct the function of closing the membrane valve 900. In this case, the same effects as those described in the above example can be obtained.

Figure 17A:
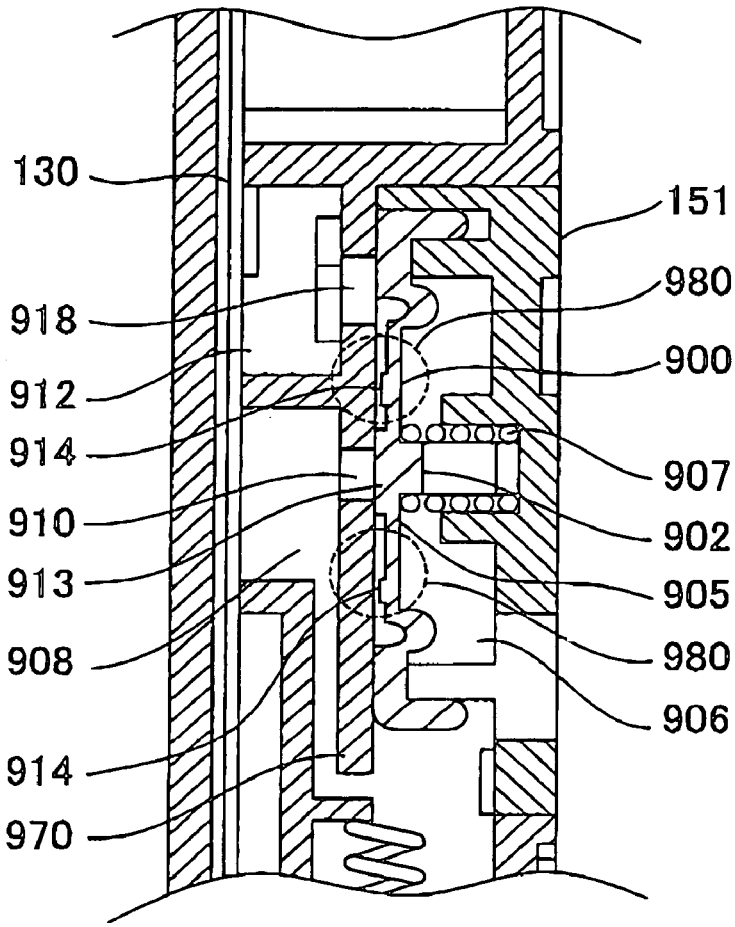
FIG. 17A is a cross-sectional view of an exemplary supply controlling portion.
Figure 17B:
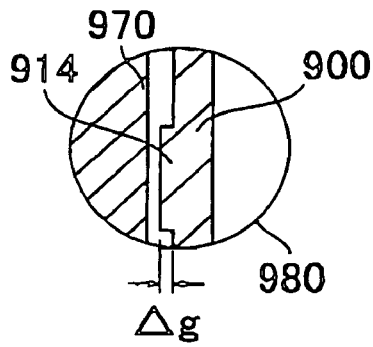
FIG. 17B is an enlarged cross-sectional view of the deformation regulating portion.
Figure 18:
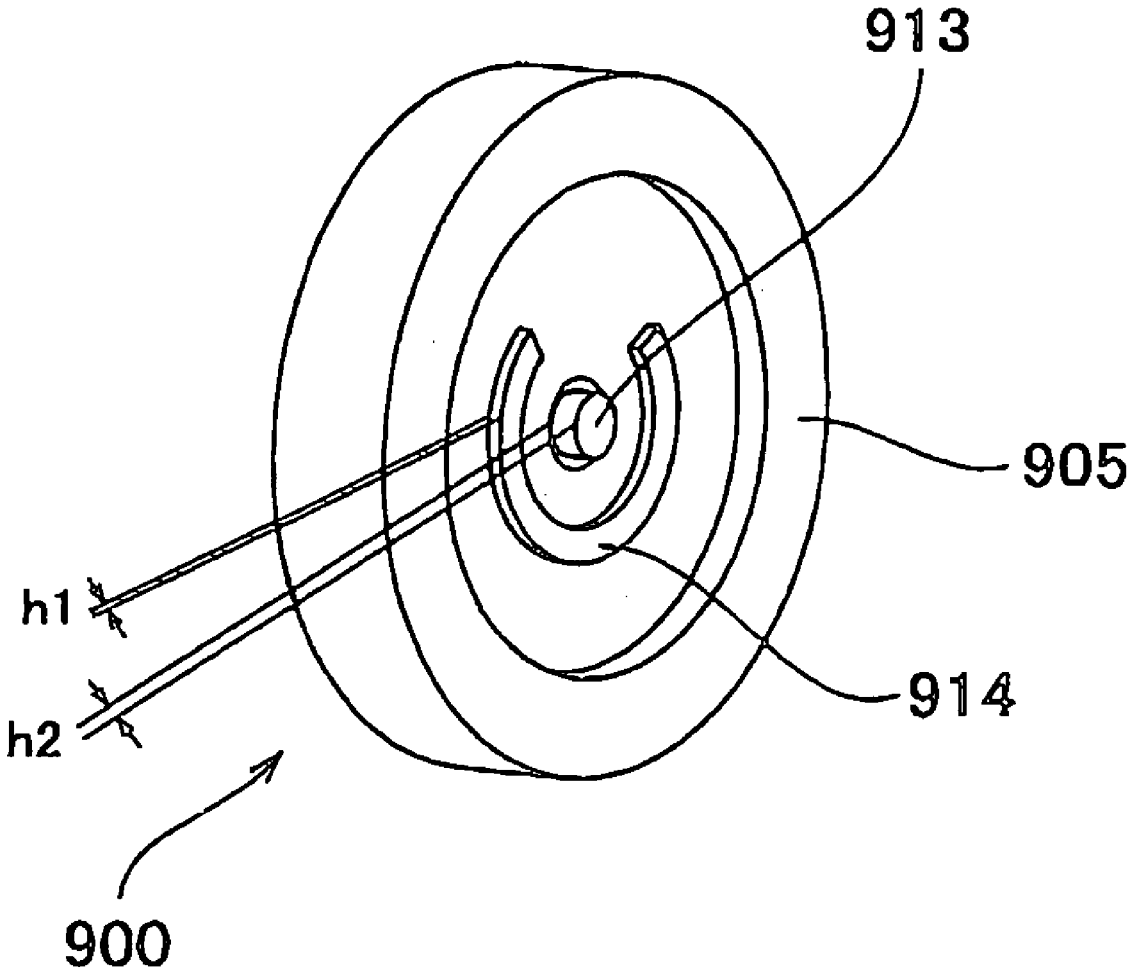
FIG. 18 is a perspective view of an exemplary deformation regulating portion as the structure of the membrane valve.

FIGS. 17A, 17B and 18 show another example of the deformation regulating portion 980 as the structure of the membrane valve 900. The approximately annular ridge 914 may be formed in the outer portion of the projection 913 of the membrane valve 900, so as to include a cut portion that is opposed to the communication hole 918 of the partitioning wall 970. In this case, the same effects as those described in the above example can be obtained. In this example, the ridge 914 is formed in such a manner that the height h1 is lower than the height h2 of the projection 913 of the membrane valve 900 and the gap Δg can be formed between the membrane valve 900 and the partitioning wall 970 when the membrane valve 900 is closed, as shown in FIG. 17B, so as not to obstruct the valve-closing function.

Figure 19A:
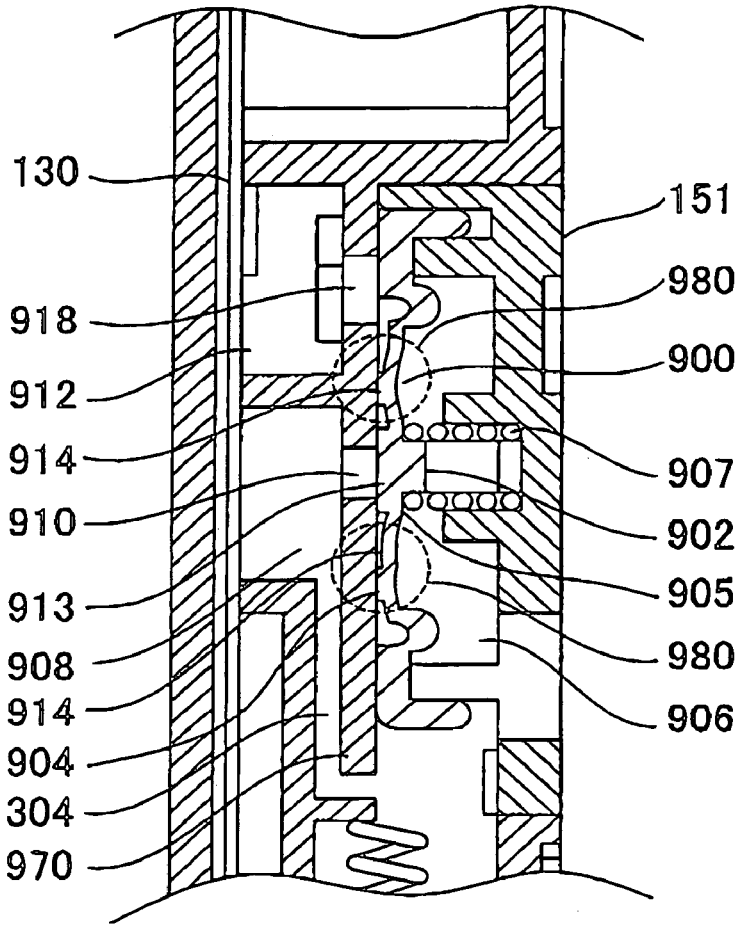
FIG. 19A is a cross-sectional view showing the shape of the membrane valve at a time at which the ink cartridge according to the present invention has been mounted onto the holder.
Figure 19B:
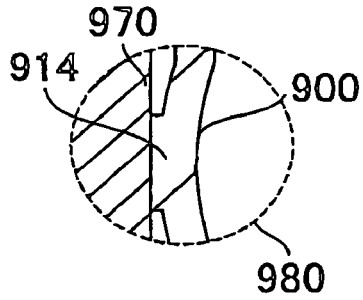
FIG. 19B is an enlarged cross-sectional view of the deformation regulating portion at the time when the ink cartridge according to the present invention has been mounted onto the holder.

Also in this example, the ink supply port 160 is in communication with ambient air via the liquid ejection head 203 communicating with the ink-supply needle 201 at the time at which the ink supply port 160 has come into contact with the ink-supply needle 201. Thus, the membrane valve 900 receives atmospheric pressure on its ink-supply-portion side and the negative pressure of the atmospheric-side accommodating chamber 270 on the other side and therefore the membrane valve 900 tends to be elastically deformed toward the partitioning wall 970, as shown in FIGS. 19A and 19B. However, the ridge 914 of the membrane valve 900 comes into contact with the partitioning wall 970, so that the membrane valve 900 is stopped at a predetermined position. Thus, the deformation amount is suppressed to significantly small, and therefore the deformation has no effect on the formation of liquid drops, although meniscus at the nozzle opening of the liquid ejection head 203 is drawn slightly.

In the above example, the approximately annular deformation regulating portion is formed to have the cut portion. Alternatively, the deformation regulating portion may be formed by a plurality of parts distributed on the partitioning wall 970 so as not to obstruct the valve-closing function. In this case, the same effect can be obtained.

Figure 20A:
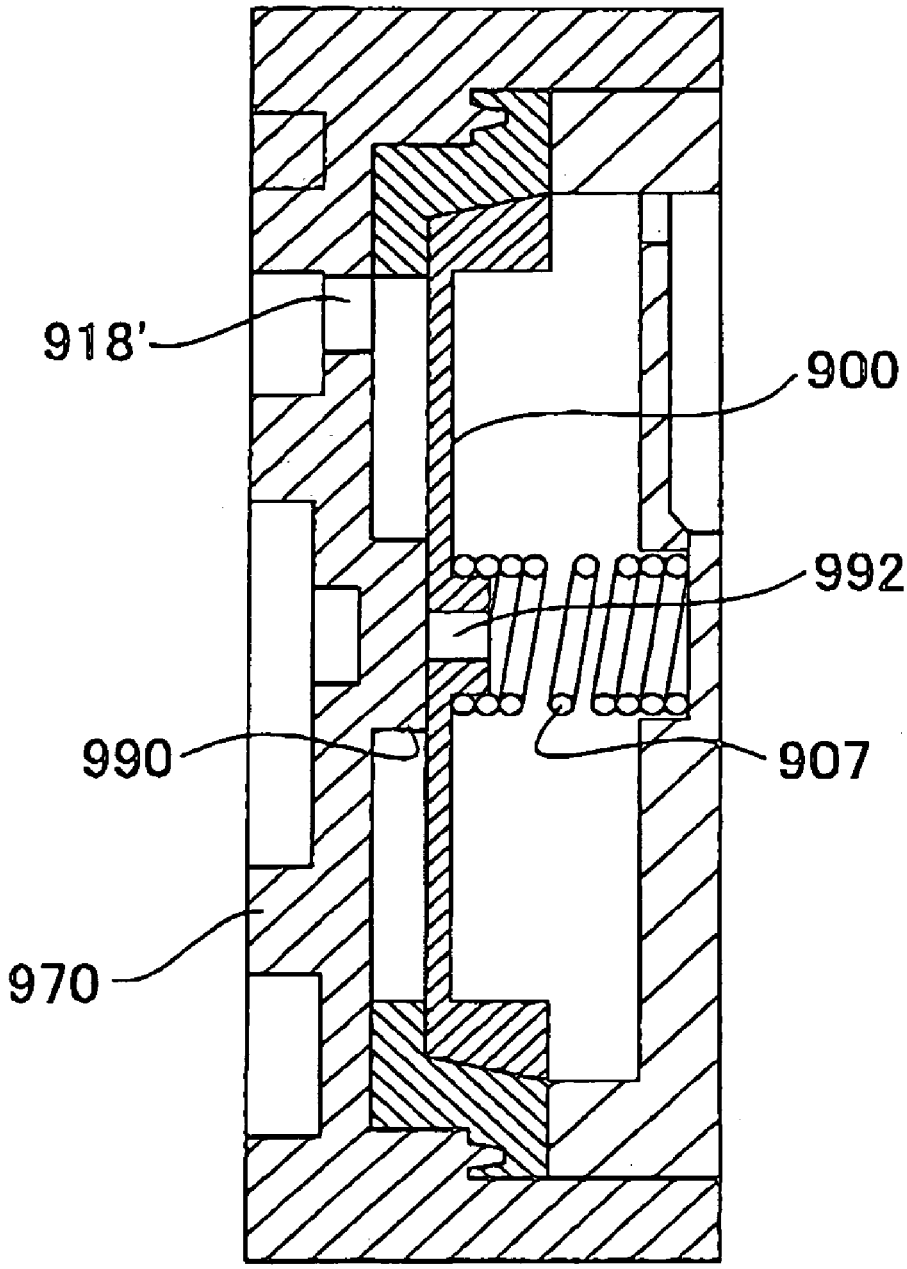
FIGS. 20A and 20B show a supply controlling portion to which the present invention can be applied.
Figure 20B:
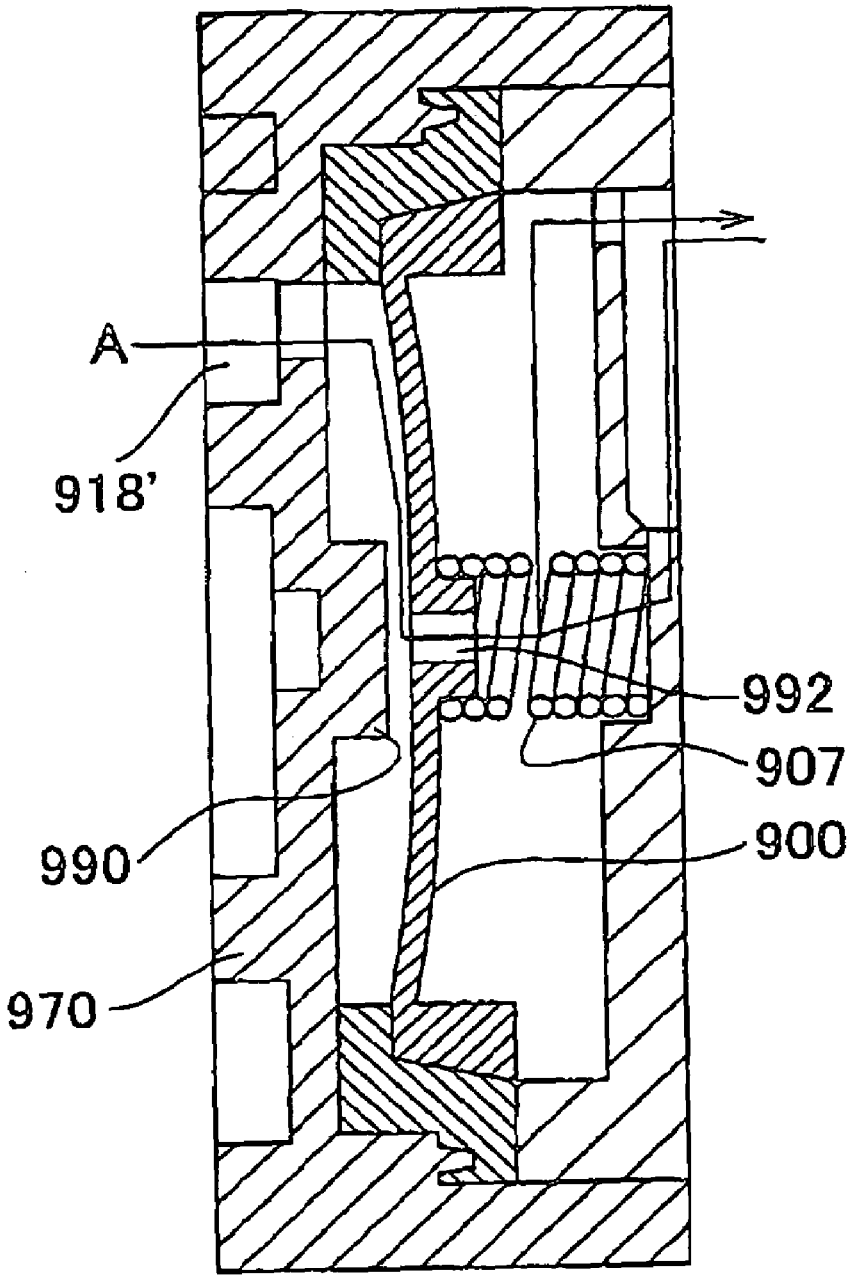

In the above example, the differential pressure regulating valve of the ink cartridge has a structure in which the communication hole 910 is formed around the center of the partitioning wall 970 and the membrane valve 900 is moved in accordance with the pressure on the ink-supply-portion side to open and close the communication hole 910. However, the present invention can be applied to the ink-supplying controlling portion having the structure shown in FIG. 20A. In the structure shown in FIG. 20A, a single communication hole 918' is formed in a region other than the center of the partitioning wall 970; a projection 990 is formed around the center of the partitioning wall 970; and a communication hole 992 is formed around the center of the membrane valve 900 in such a manner that it can come into elastic contact with the projection 990. The communication hole 992 of the membrane valve 900 is normally closed by bringing the communication hole 992 into contact with the projection 990 with the coil spring 907. When the pressure in the ink supply portion is reduced, the membrane valve 900 is made to go away from the projection 990 against the elastic force of the coil spring 907, as show in FIG. 20B, thereby supplying ink along the line shown with A in FIG. 20B via the communication hole 992 of the membrane valve 900. In this case, the same effects as those described in the description of the above examples can be obtained.

Figure 21A:
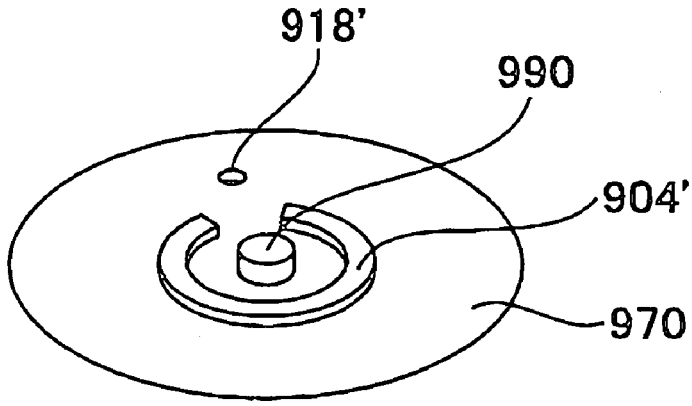
FIGS. 21A and 21B show an exemplary deformation regulating portion that can be applied to the supply controlling portion shown in FIGS. 20A and 20B.
Figure 21B:
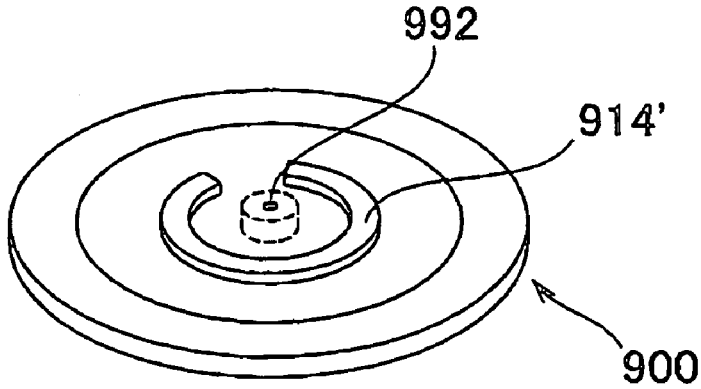

The excessive deformation of the membrane valve 900 toward the partitioning wall 970 can be regulated by providing a ridge 904' on the face of the partitioning wall 970, that is a face opposed to the membrane valve 900, to have a cut portion in the outer region of the projection 990 near the communication hole 918', as shown in FIG. 21A, or forming a ridge 914 on the face of the membrane valve 900 that is a face opposed to the partitioning wall 970, to surround the communication hole 992 and to have a cut portion in a region opposed to the communication hole 918' of the partitioning wall 970.

Next, FIGS. 22 through 25 concern a method for injecting liquid into the ink cartridge 100 and pressures in the respective parts in the ink cartridge 100 according to another embodiment of the present invention. The ink cartridge shown in FIGS. 22–25 is similar in the fundamental structure to that shown in FIGS. 1–11. However, in the embodiment shown in FIGS. 22 through 25, the partition wall 970 is not provided with the ridge 904 and the membrane valve 900 is not provided with the ridge 914. Therefore, only the parts different between the cartridge shown in FIGS. 22–25 and that shown in FIGS. 1–11 are described.

Figure 22:
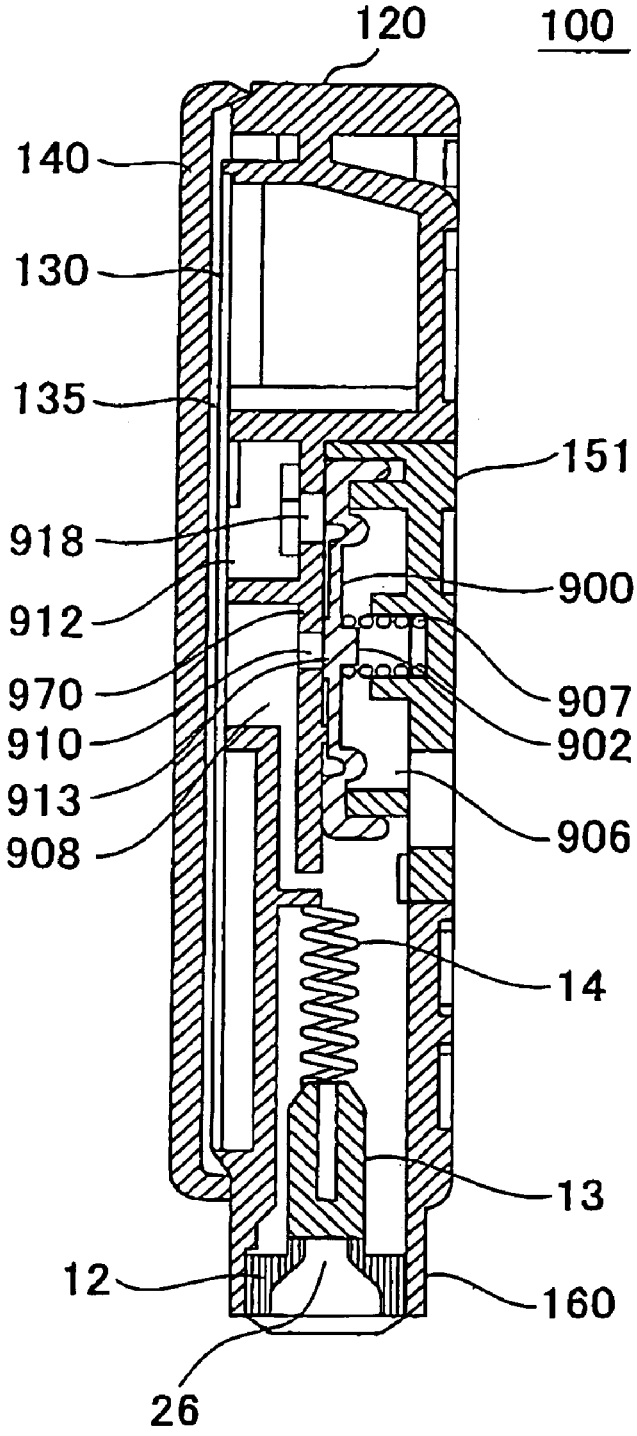
FIG. 22 is a cross-sectional view of an exemplary supply member of the ink cartridge.

Referring to FIG. 22, on the outer surface of the film 130 put on the opening of the cartridge body 120 to adhere thereto, the cover 140 is fitted to be in close contact with the film 130 in such a manner that the volume of the space between the film 130 and the cover 140 is reduced as small as possible. Thus, it is possible to prevent inadequate expansion of the film 130 in a case where the ink cartridge 100 is accommodated in the vacuum bag 101 and damage of the film 130 by hit with a protrusion or the like.

Figure 23A:
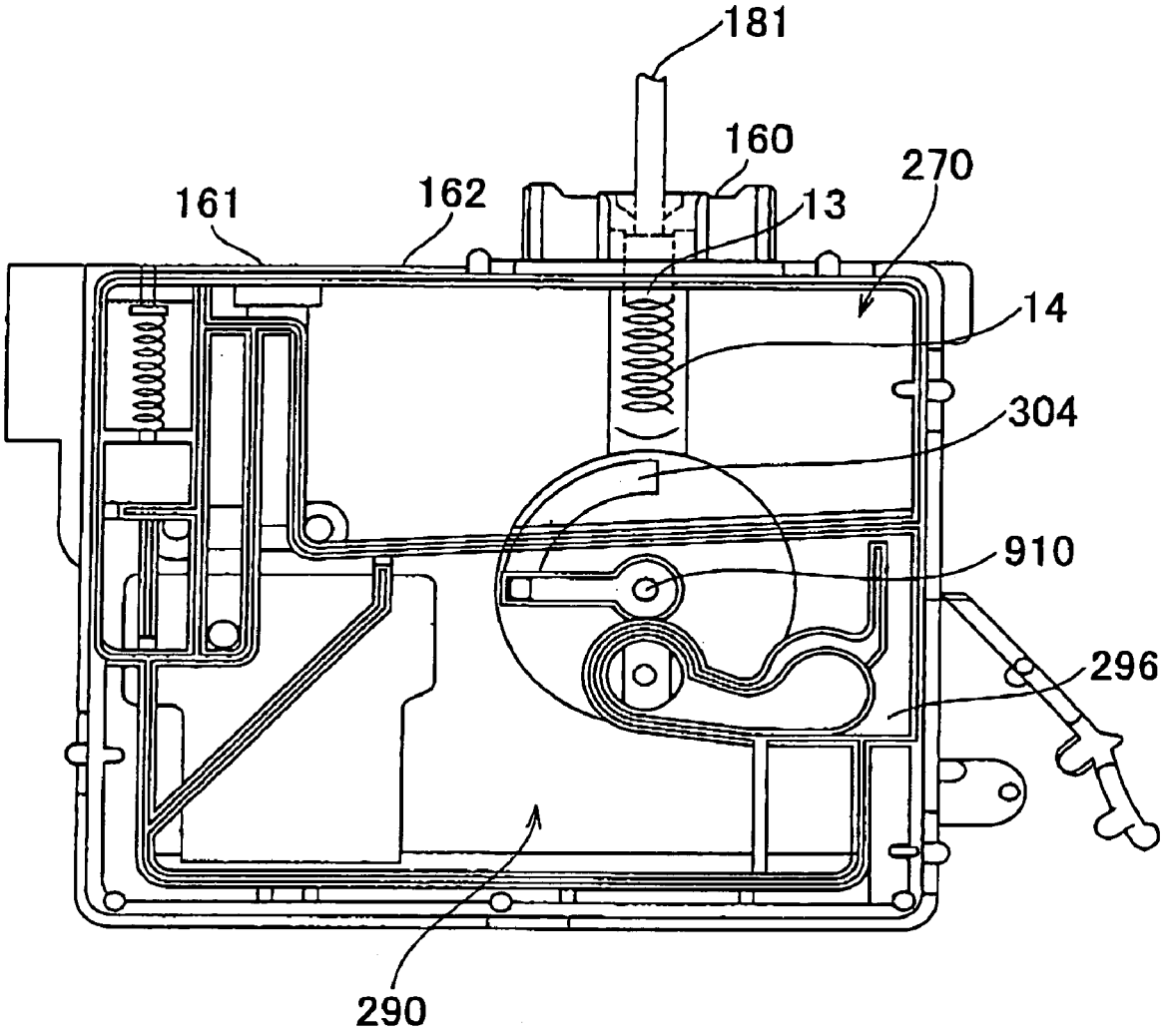
FIGS. 23A and 23B show processes in the first half of ink filling, respectively.

As shown in FIG. 23A, the ink supply port 160 includes a supply valve 13 that is slidable by being pressed by the ink-supply needle of the holder to be opened, a sealing member 12 provided to be fitted to surround the ink-supply needle, that has an insertion port 26, and a biasing member 14 formed by a coil spring for pressing the supply valve 13 toward the sealing member 12. The supply valve 13, the sealing member 12 and the biasing member 14 are assembled in the following manner. The biasing member 14 is attached in the cartridge body 120, and then the sealing member 12 is fitted in the ink supply port 160. Finally, the supply valve 13 is pushed inside the ink supply port 160 from the insertion port 26. In this way, a process for holding the spring is not required in the assembly. The assembly can be done only by mounting the components of the ink supply port 160.

On the outer periphery 905 of the membrane valve 900, an annular groove is formed so as to be elastically deformed or moved easily in accordance with a differential pressure to seal or open the communication hole 910.

Moreover, a filter 310 for filtrating ink can be accommodated in the body-side communication chamber 912, as shown in FIG. 22. In this case, it is possible to block foreign particles contained in the ink so as to block the moving of the foreign particles toward the downstream, thereby ensuring the sealing function of the membrane valve 900. It is also possible to prevent clogging of the liquid ejection head such as a recording head. Please note that the example shown in FIG. 22 includes no ridge 904.

In the ink cartridge 100 having the above structure, an exhaust tube 181 is first inserted into the ink supply port 160 in an airtight manner so that the supply valve 13 is pushed further inside, as shown in FIG. 23A. Thus, the supply valve 13 is opened and air inside the ink supply port 160 is exhausted. At this time, the membrane valve 900 receives the negative pressure in the ink supply port 160 in a large area on the back face of the membrane valve 900 and therefore overcomes the force applied by the spring 907 to move away from the partitioning wall 970. Thus, air in the ink accommodating chamber 111 (270 and 290) is suctioned into the ink supply port 160 via the communication hole 910 and the communication section 304. This suction continues for a predetermined time, thereby the pressure inside the ink cartridge 100 is reduced until the inside of the ink cartridge 100 becomes vacuum.

Figure 23B:
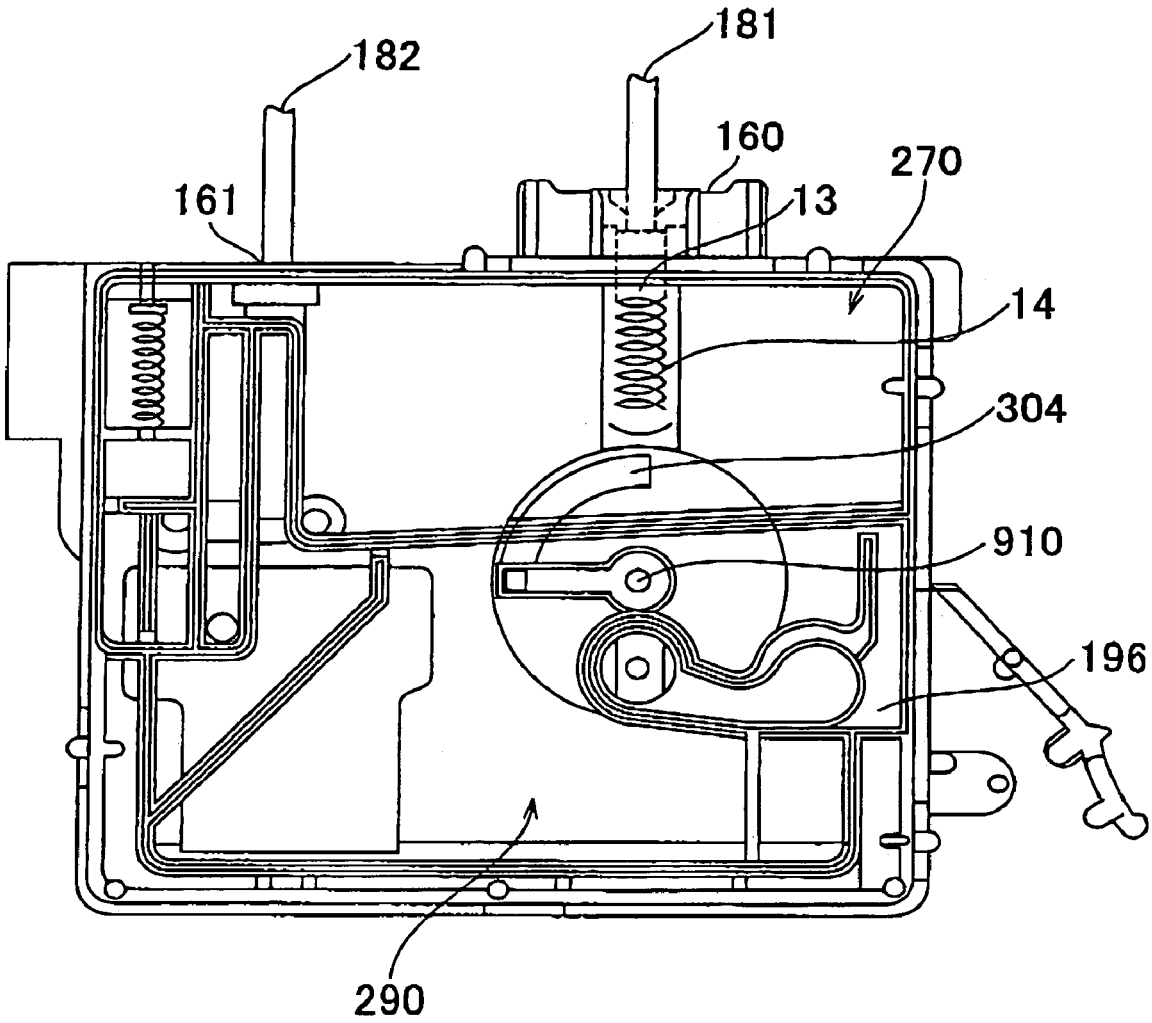

Then, when an ink injecting tube 182 is inserted into the first ink inlet 161 in a liquid-tight manner, as shown in FIG. 23B, ink is suctioned into the ink accommodating chamber 111 (270 and 290) that is under reduced pressure. Thus, almost all the space from the liquid-supply-side accommodating chamber 290 to the ink supply port 160 is filled with the ink with no air contained.

Figure 24A:
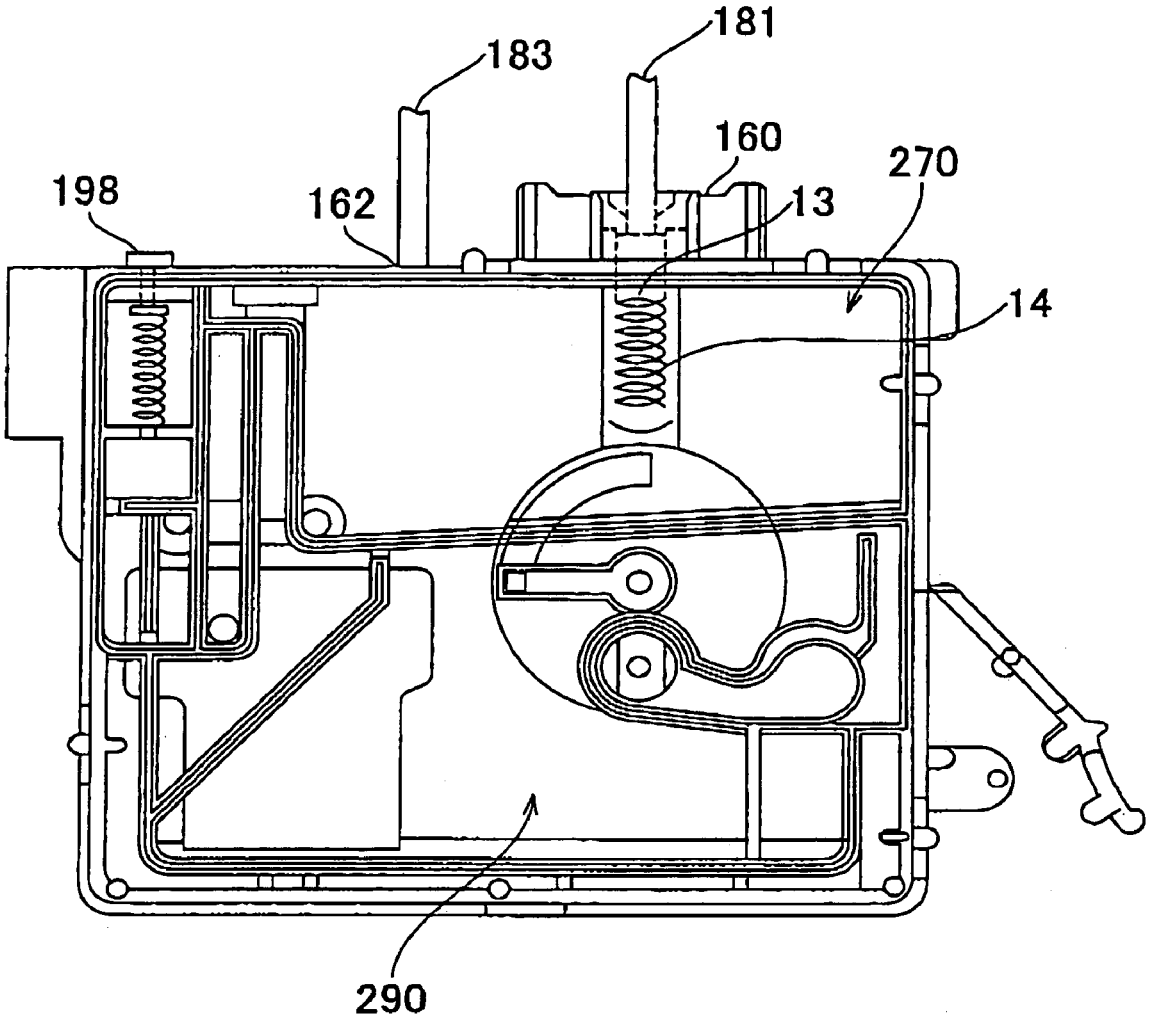
FIGS. 24A and 24B show processes in the last half of ink filling, respectively.
Figure 24B:
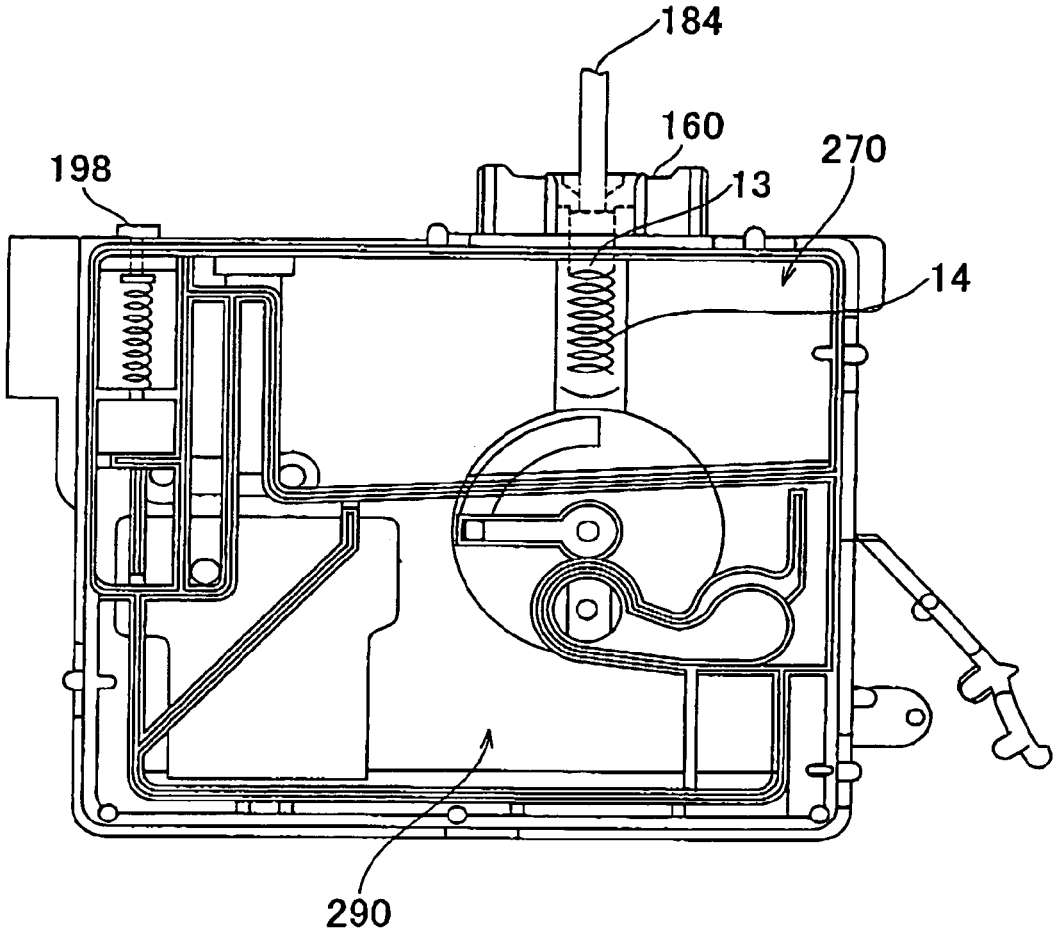

Subsequently, the axis 264 of the atmospheric valve 254 is pushed inside by the pressing member 980 to open the atmospheric valve 254, as shown in FIG. 24A, so that the atmospheric-side accommodating chamber 270 of the ink cartridge 100 communicates with ambient air. Then, an ink injecting tube 183 is inserted into the second ink inlet 162 in a liquid-tight manner and thereafter ink is injected into the atmospheric-side accommodating chamber 270 under pressure. Please note that a process of opening the atmospheric valve 254 and a process of injecting ink can be performed simultaneously. In this case, the time required for the ink injecting process can be shortened.

In this state, there is no pressure difference between the ink accommodating chamber 111 and the ink supply port 160. Therefore, the pressure is the same on both sides of the membrane valve 900, i.e., in the upstream of the membrane valve 900 and in the downstream thereof. Thus, the membrane valve 900 is kept approximately flat, as shown in FIG. 22.

Figure 25:
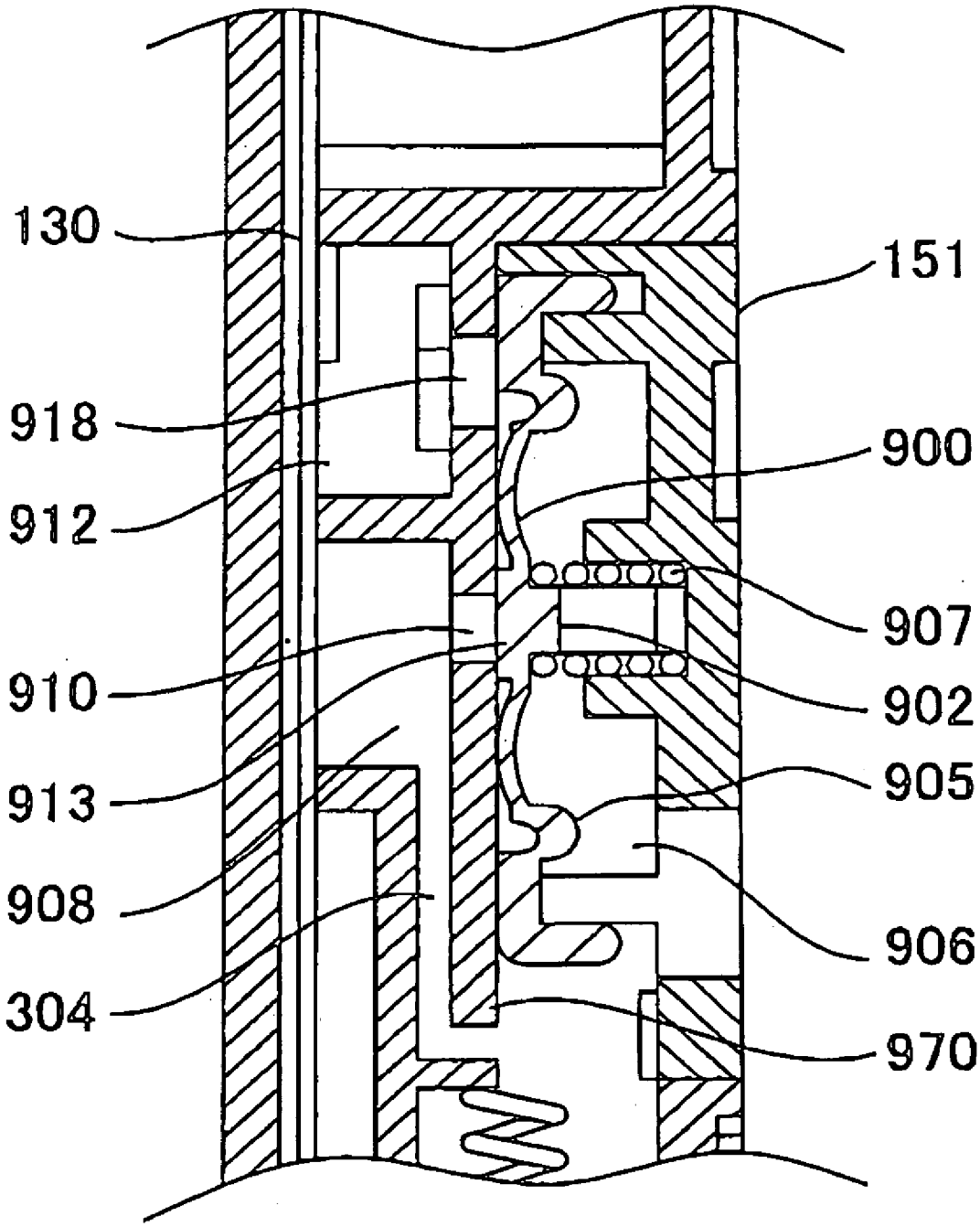
FIG. 25 is an enlarged cross-sectional view of the membrane valve, showing a state after ink filling.

In this state, an ink injecting tube 184 is inserted into the ink supply port 160 in a liquid-tight manner to such a depth that the supply valve 13 is opened, and thereafter ink is injected into the ink supply port 160 under pressure. Thus, the pressurized ink flows into the downstream of the membrane valve 900, i.e., the side of the membrane valve 900, which communicates with the ink supply port 160, so that the membrane valve 900 is elastically deformed in such a manner that the region around the center of the membrane valve 900 becomes convex toward the partitioning wall 970, as shown in FIG. 25. In a state immediately after that injection of pressurized ink, an area of the membrane valve 900 receiving the pressure is larger on the side close to the coil spring 907 than on the other side, and the cross-sectional area of the communication hole 910 of the partitioning wall 970 is considerably small. Therefore, the membrane valve 900 is placed in a state in which it is pressed toward the partitioning wall 970.

Then, at a time when a predetermined amount of additional injection of ink has been finished, the pressing member 980 is moved away to move the atmospheric valve 254 to a sealing position, and the ink injecting tube 184 is removed from the ink supply port 160. Thus, the support for the supply valve 13 is moved away from the supply valve 13 and therefore the supply valve 13 is closed by the force applied by the biasing member 14. In this manner, the pressure in the space from the ink supply port 160 to the membrane valve 900, i.e., the space in the downstream of the membrane valve 900 becomes higher than that in the upstream of the membrane valve 900.

At a time when the ink filling has been finished, a seal 604 is placed on the ink supply port 160 to adhere thereto. Moreover, the film 132 is placed on the first ink inlet 161 and the second ink inlet 162 to adhere there to under reduced pressure, thereby the inside of the cartridge is sealed under a pressure lower than atmospheric pressure.

Subsequently, the cartridge is put into the vacuum bag 101 and then the opening of the vacuum bag 101 is sealed under a pressure lower than the pressure inside the cartridge. Thus, the cartridge is packaged under reduced pressure, as shown in FIG. 12. The cartridge thus packaged is distributed in this state. During the distribution, air in the ink accommodating chamber 111 gradually leaks to enter the space between the vacuum bag 101 and the cartridge through the housing walls of the ink cartridge 100. Thus, the pressure in the ink accommodating chamber 111 and the space from the membrane valve 900 to the ink supply port 160 can be kept under atmospheric pressure, thereby ink can be kept in a state where air has been expelled. It will be apparent that, since ink existing in the space from the membrane valve 900 to the ink supply port 160 receives the reduced pressure that is approximately even between the ink supply port 160 and the ink accommodating chamber 111, the membrane valve 900 keeps elastic deformation caused when ink filling is finished.

When the ink cartridge 100 thus packaged in the vacuum bag 101 is put out from the vacuum bag 101, is mounted onto the holder 200 as shown in FIG. 13, and is then loaded by rotating the lever 204 as shown in FIG. 14, the ink-supply needle 201 enters the ink supply port 160 and then the atmospheric valve 254 is opened by the operation member 202 provided on the bottom of the holder 200.

At a time when the ink supply port 160 has come into contact with the ink-supply needle 201, the back side of the membrane valve 900 (the coil-spring side) communicates with ambient air via the liquid ejection head 203 that communicates with the ink-supply needle 201. Therefore, the pressure of the ink acting on the region of the membrane valve 900, which is elastically deformed by additional injection of ink, is released thereby the ink is pushed into the ink-supply needle 201.

Thus, the negative pressure does not act on the ink-supply needle 201 and it is possible to prevent the disadvantage that meniscus at the nozzle opening of the liquid ejection head 203 is drawn or pulled back.

When the mounting and loading of the cartridge 100 is finished in the above-described manner, the membrane valve 900 is returned to its original state, i.e., is returned to be flat as soon as possible, as shown in FIG. 22. Therefore, it is possible to open and close the membrane valve 900 to supply ink in accordance with the pressure difference (differential pressure) between the ink supply port 160 and the liquid-supply-side accommodating chamber.

In the above example, at the time at which a predetermined amount of ink filling is finished, additional ink filling is performed from the ink supply port 160 until the center region of the membrane valve 900 is elastically deformed. Alternatively, the ink filling maybe performed in the following manner. First, the axis 264 of the atmospheric valve 254 is pressed inside by the pressing member 980 so as to communicate the atmospheric-side accommodating chamber 270 and the liquid-supply-side accommodating chamber 290 of the cartridge with ambient air, as shown in FIGS. 23A and 23B. Then, the ink injecting tube 181 and 182 are inserted into the first and second ink inlets 161 and 162 in a liquid-tight manner, respectively, and thereafter ink is injected to reach a predetermined amount.

Then, the pressing member 980 is moved back to close the atmospheric valve 254. In this state, addition a link filling is performed while ink is pressurized. The pressurized ink moves the membrane valve 900 back against the coil spring 907 and therefore enters the downstream region of the membrane valve 900. Then, when the atmospheric valve 254 is opened by the pressing member 980 at the time at which the additional ink filling has been finished, the atmospheric-side accommodating chamber 270 is opened to ambient air, thereby the pressure in the atmospheric-side accommodating chamber 270 and the liquid-supply-side accommodating chamber 290 is reduced as compared to the pressure in the additional ink filling. This reduction of pressure causes the membrane valve 900 to seal the communication hole 910 against the pressing force applied by the coil spring 907. Thus, the pressure of ink in the space from the membrane valve 900 to the ink supply port 160 increases to a pressure relatively higher than that in the atmospheric-side accommodating chamber 270 and liquid-supply-side accommodating chamber 290, so that the membrane valve 900 is elastically deformed in such a manner that the center region thereof becomes convex toward the partitioning wall 970, as shown in FIG. 25.

As described above, the ink pressure acting on the center region of the membrane valve 900 that is elastically deformed by the additional ink filling is released at the time at which the mounting of the cartridge onto the ink-supply needle has been finished, thereby acting so as to push out the ink to enter the ink-supply needle 201. Therefore, it is possible to prevent the disadvantage that meniscus at the nozzle opening of the liquid ejection head 203 is drawn.

In the above example, the ink cartridge having the air valve as the structure for communicating the ink accommodating chamber with ambient air by engagement of the ink cartridge with the recording apparatus. Alternatively, the present invention can be applied to an ink cartridge in which engagement between the ink cartridge and the recording apparatus opens a portion of the passage communicating with the air-side of the ink accommodating chamber so as to communicate the ink accommodating chamber communicate with ambient air. In this case, the same effect as that described in the above example can be obtained.

Another embodiment of the atmospheric valve section 250 of the present invention will now be described with reference to FIGS. 2 through 7. According to the present embodiment, the atmospheric valve section 250 includes the atmospheric valve accommodating section 232 in which the atmospheric valve 254 is accommodated. The atmospheric valve section 250 also includes a communication hole 239 having a diameter slightly larger than the diameter of the axis 264 of the atmospheric valve 254 in the lower wall of the atmospheric valve accommodating section 232. The communication hole 239 also serves as a flow path. The axis 264 of the atmospheric valve 254 is always biased toward the bottom of the cartridge 100 by a spring 255 in such a manner that the axis 264 of the atmospheric valve 254 can be slidably inserted into the communication hole 239. Thus, the atmospheric valve 254 seals the communication hole 239 when the ink cartridge 100 is not mounted in a cartridge holder 200 of the carriage of the ink-jet recording apparatus described later. Accordingly, the atmospheric valve 254 is arranged so that it is movable in a direction substantially perpendicular to the direction in which the ink cartridge 100 is mounted on the holder 200 of the carriage. When the ink cartridge is to be mounted on the holder, the atmospheric valve 254 is pushed upward by an abutment member 60, which is an example of an abutment formed in the holder of the carriage, and the communication hole 239 is opened. In addition, an aspect of the spring load of the spring 255 will be described later.

The coil spring 255 shown in FIG. 6 is an example of a biasing member of the present invention. The coil spring 255 biases the atmospheric valve 254 toward the communication hole 239 from a side of the ink-accommodating-chamber 111 to a side of atmosphere. Accordingly, when the ink cartridge 100 is not mounted on the ink-jet recording apparatus, the atmospheric valve 254 seals the communication hole 239, and isolates the ink accommodating chamber 111 from ambient air. Here, the spring load of the coil spring 255 is determined so that the atmospheric valve 254 is pushed back against the force of the spring 255 by the atmospheric pressure and the communication hole 239 is opened when the ink cartridge 100 is exposed to atmospheric pressure. For example, the force of the spring 255 against the atmospheric valve 254 is less than a force obtained by multiplying (1) a pressure difference between the atmospheric pressure and a pressure in the ink accommodating chamber 111 at the time when the package of the ink cartridge is opened, by (2) an area of the film 132, which contacts the axis 264 of the atmospheric valve 254, which is deformable when the film 132 is exposed to the ambient air.

After the ink is accommodated in the ink accommodating chamber 111 of the ink cartridge 100 having the above-mentioned configuration, the ink cartridge 100 is packed in a vacuum package made of aluminum, for example, and sealed under a pressure lower than atmospheric pressure. Accordingly, inside of the ink accommodating chamber 111 of the ink cartridge 100 is also vacuumed to be lower than the atmospheric pressure. From this state, when the vacuum package is opened, the ink cartridge 100 will be exposed to atmosphere. In this case, since atmospheric pressure is higher than the pressure in the ink accommodating chamber 111, pressure is applied on the atmospheric valve 254 from the side exposed to the atmosphere to the side of the ink-accommodating-chamber 111. Since the spring 255, which biases the atmospheric valve 254 toward the communication hole 239 from the side of the ink-accommodating-chamber 111 has the above-mentioned biasing force, the atmospheric valve 254 moves upward by atmospheric pressure against the force of the spring 255 and the communication section 224 is opened. Therefore, the ink accommodating chamber 111 is in communication with ambient air through the communication hole 239 and the pressure in the ink accommodating chamber 111 increases. Accordingly, the atmospheric valve 254 can reduce the pressure difference between the ink accommodating chamber 111 and atmosphere.

When the pressure of the ink accommodating chamber 111 further increases and the pressure difference between the ink accommodating chamber 111 and atmosphere is further reduced from the above-mentioned state, the force of the spring 255 becomes greater than the force applied to the atmospheric valve 254 by the differential pressure between the ink accommodating chamber 111 and atmosphere, so that the atmospheric valve 254 seals the communication hole 239 once again. Accordingly, the communication hole 239 is kept sealed when the ink cartridge 100 is not mounted in the ink-jet recording apparatus, so that it is possible to prevent ink leak from the ink cartridge 100.

As described above, according to the ink cartridge 100 of the present embodiment, since the atmospheric valve 254 once moves upward by atmospheric pressure against the force of the biasing member for opening the communication section 224 when the vacuum package which packs the ink cartridge 100 is opened, the difference between. the pressure in the ink cartridge 100 and the atmospheric pressure is reduced by exposing the ink cartridge 100 to atmosphere. Accordingly, when the ink cartridge 100 is mounted in the ink-jet recording apparatus, the ink cartridge 100 is prevented from drawing ink from the recording head of the ink-jet recording apparatus, and trouble of the recording head caused by the entry of the air bubbles to the recording head is preventable.

Moreover, as shown in FIG. 5, since the spring 255 is employed as the biasing member in the present embodiment, how much the pressure difference between the ink accommodating chamber 111 of each ink cartridge 100 and atmosphere is to be reduced is adjustable by appropriately selecting the spring load of the spring 255. For example, the lower the spring load of the spring 255 is, the lesser the pressure difference between the ink accommodating chamber 111 and atmosphere becomes when the vacuum package is opened.

Furthermore, as described above with reference to FIGS. 2 and 3, since the ink supply port 160 is sealed by a seal 604, the ink supply port 160 is isolated from atmosphere, so that the ink accommodating chamber 111 is prevented from being exposed to atmosphere via the ink supply port 160. Therefore, when the vacuum package is opened and the ink cartridge 100 is exposed to ambient air, the atmospheric valve 254 moves without failure and the negative pressure in the ink accommodating chamber 111 is reduced assuredly.

Although the present invention has been described by way of exemplary embodiments, it should be understood that those skilled in the art might make many changes and substitutions without departing from the spirit and the scope of the present invention which is defined only by the appended claims.

What is claimed is:

1. A liquid cartridge for supplying liquid to a liquid ejecting apparatus when mounted thereon, comprising:

a housing having a side face in which an opening is formed, said housing including a liquid supply section for supplying the liquid to said liquid ejecting apparatus;

a flexible film covering said opening of said housing and defining a liquid accommodating chamber, said flexible film being deformable by a differential pressure between atmospheric pressure and a pressure in said liquid accommodating chamber, and wherein said flexible film includes a plurality of layers, and a material of an innermost one of said plurality of layers is the same as a material of said housing; and an opening portion for communicating said liquid accommodating chamber with ambient air.

2. A liquid cartridge as claimed in claim 1, wherein said liquid accommodating chamber includes an atmospheric-side accommodating chamber to be in communication with ambient air and a liquid-supply-side accommodating chamber in communication with said atmospheric-side accommodating chamber, and said film covers said atmospheric-side accommodating chamber and said liquid-supply-side accommodating chamber.

3. A liquid cartridge as claimed in claim 1, wherein said film further includes an anti-permeation layer for preventing permeation of liquid vapor in said liquid cartridge to an outside of said liquid cartridge through said film.

4. A liquid cartridge as claimed in claim 1, wherein said film further includes a strengthening layer that is higher in strength than said innermost layer.

5. A liquid cartridge as claimed in claim 1, further comprising:

a passage provided on a surface of said housing, said passage being opened to ambient air at one end; and a chamber provided on the way of said passage, said chamber having a depth deeper than a depth of said passage.

6. A liquid cartridge as claimed in claim 1, further comprising a cover, provided in an outside of said film, for preventing expansion of said film to the outside.

7. The liquid cartridge as claimed in claim 1, wherein the flexible film covers only a single side of the liquid accommodating chamber.

8. A liquid cartridge for supplying liquid to a liquid ejecting apparatus when mounted thereon, comprising:

a liquid accommodating chamber;

a supply portion for supplying liquid accommodated in said liquid accommodating chamber to said liquid ejecting apparatus;

a partitioning wall, provided between said liquid accommodating chamber and said supply portion, having a communication hole communicating said liquid accommodating chamber with said supply portion;

a membrane valve, arranged on a supply-portion side of said partitioning wall, for controlling communication or non-communication between said liquid accommodating chamber and said supply portion, wherein said membrane valve closes by coming into contact with said communication hole of said partitioning wall; and a deformation regulating portion allowing said membrane valve to be closed and to regulate elastic deformation of said membrane valve toward said liquid accommodating chamber caused by increase of a pressure on a supply-portion side of said membrane valve.

9. A liquid cartridge as claimed in claim 8, wherein said deformation regulating portion is formed by a protrusion provided at a position of said partitioning wall, said position being opposed to a periphery region of said membrane valve.

10. A liquid cartridge as claimed in claim 8, wherein said deformation regulating portion is provided on a face of said membrane valve, said face being opposed to said partitioning wall, and said deformation regulating portion is formed as a thicker portion that comes into contact with said partitioning wall when said membrane valve is closed.

11. A liquid cartridge as claimed in claim 8, wherein said deformation regulating portion is formed as an approximately annular ridge having a cut portion in a region connecting communication holes formed in said partitioning wall.

12. A liquid cartridge as claimed in claim 8, wherein said membrane valve includes a communication hole formed therein, and a sealing portion for sealing said communication hole of said membrane valve is formed on said partitioning wall.

13. A liquid cartridge for supplying liquid to a liquid ejecting apparatus when mounted thereon, comprising:

a liquid accommodating chamber for accommodating liquid;

a supply portion for supplying liquid accommodated in said liquid accommodating chamber to said liquid ejecting apparatus; and a membrane valve, provided between said liquid accommodating chamber and said supply portion, for controlling communication or non-communication between said liquid accommodating chamber and said supply portion, wherein said liquid cartridge is filled with said liquid in such a manner that a pressure on a supply-portion side of said membrane valve is higher than a pressure on a liquid-accommodating portion side of said membrane valve to a degree allowing elastic deformation of said membrane valve, and wherein the control of the communication or non-communication between said liquid accommodating chamber and said supply portion is performed by moving said membrane valve closer to or away from a communication hole formed in a partitioning wall for sectioning said liquid accommodating chamber and said supply portion to open and close said communication hole.

14. A liquid cartridge for supplying liquid to a liquid ejecting apparatus when mounted thereon, comprising:

a liquid accommodating chamber for accommodating liquid;

a supply portion for supplying liquid accommodated in said liquid accommodating chamber to said liquid ejecting apparatus; and a membrane valve, provided between said liquid accommodating chamber and said supply portion, for controlling communication or non-communication between said liquid accommodating chamber and said supply portion, wherein said liquid cartridge is filled with said liquid in such a manner that a pressure on a supply-portion side of said membrane valve is higher than a pressure on a liquid-accommodating portion side of said membrane valve to a degree allowing elastic deformation of said membrane valve, and wherein the control of the communication or non-communication between said liquid accommodating chamber and said supply portion is performed by forming a communication hole in said membrane valve, sectioning said liquid accommodating chamber and said supply portion by said membrane valve, and moving said communication hole of said membrane valve away from a sealing member to open said communication hole or closing said communication hole with said sealing member.

15. A liquid cartridge for supplying liquid to a liquid ejecting apparatus when mounted thereon, comprising:

a liquid accommodating chamber for accommodating liquid;

a supply portion for supplying liquid accommodated in said liquid accommodating chamber to said liquid ejecting apparatus;

a membrane valve, provided between said liquid accommodating chamber and said supply portion, for controlling communication or non-communication between said liquid accommodating chamber and said supply portion; and an opening portion for communicating said liquid accommodating chamber with ambient air in accordance with a state of liquid consumption in said liquid accommodating chamber, wherein said liquid cartridge is filled with said liquid in such a manner that a pressure on a supply-portion side of said membrane valve is higher than a pressure on a liquid-accommodating portion side of said membrane valve to a degree allowing elastic deformation of said membrane valve, and wherein said opening portion is operated by a pressing member formed on a holder onto which said liquid cartridge is mounted.

16. A method of manufacturing a liquid cartridge including: a liquid accommodating chamber; a supply portion for supplying liquid accommodated in said liquid accommodating chamber to a liquid ejecting apparatus; and a membrane valve, provided between said liquid accommodating chamber and said supply portion, for controlling communication or non-communication between said liquid accommodating chamber and said supply portion, wherein said liquid cartridge supplies said liquid to said liquid ejecting apparatus when mounted thereon, the method comprising:

a first step for injecting liquid to said liquid accommodating chamber; and a second step for loading a connector for liquid injection into said supply portion and injecting said liquid until a pressure in a space from said supply portion to said membrane valve is increased to cause elastic deformation of said membrane valve and to close a communication hole through which the liquid accommodating chamber communicates with the supply portion.

17. A method as claimed in claim 16, wherein said first step is performed after discharge of air from a space between said supply portion to said liquid accommodating chamber.

18. A method of manufacturing a liquid cartridge including: a liquid accommodating chamber; a supply portion for supplying said liquid accommodated in said liquid accommodating chamber to a liquid ejecting apparatus; and a membrane valve, provided between said liquid accommodating chamber and said supply portion, for controlling communication or non-communication between said liquid accommodating chamber and said supply portion, wherein said liquid cartridge supplies said liquid to said liquid ejecting apparatus when mounted thereon, said method comprising:

a first step for injecting liquid into said liquid accommodating chamber while said liquid is pressurized; and a second step for communicating said liquid accommodating chamber with ambient air to relatively increase a pressure in a space from said supply portion to said membrane valve to cause elastic deformation of said membrane valve and to close a communication hole through which the liquid accommodating chamber communicates with the supply portion.

19. A method as claimed in claim 18, wherein said first step is performed after discharge of air from a space between said supply portion to said liquid accommodating chamber.

20. A liquid cartridge for supplying liquid to a liquid ejecting apparatus when mounted thereon, comprising:

a liquid accommodating chamber;

a supply portion for supplying liquid accommodated in said liquid accommodating chamber to the liquid ejecting apparatus;

an atmospheric valve selectively opening and sealing a communication hole through which said liquid accommodating chamber communicates with ambient air; and a biasing member for biasing said atmospheric valve toward said communication hole for sealing the communication hole, wherein a biasing force of said biasing member is determined so that said atmospheric valve opens the communication hole when the liquid cartridge with the liquid accommodating chamber, which is packed and sealed in a vacuum package under a negative pressure lower than atmospheric pressure, is exposed to atmosphere by opening the package, and wherein said vacuum package is sealed under a pressure lower than a pressure within said liquid cartridge.

21. The liquid cartridge as claimed in claim 20, wherein said biasing member comprises a spring.

22. The liquid cartridge as claimed in claim 21, wherein said spring biases said atmospheric valve toward the communication hole from a side of said liquid accommodating chamber to a side of atmosphere.

23. The liquid cartridge as claimed in claim 20, further comprising a seal for sealing said supply portion, wherein said seal is removed before initial use of the liquid cartridge.

* * * * *